US008777170B2

(12) United States Patent
Gilbert et al.

(10) Patent No.: US 8,777,170 B2
(45) Date of Patent: Jul. 15, 2014

(54) DISPLAY ARTICLE SUPPORT SYSTEMS

(75) Inventors: Leonard M. Gilbert, Beverly Hills, CA (US); Mark A. Presser, Los Angeles, CA (US)

(73) Assignee: Lenmark Holdings, LLC, Los Angeles, CA (US)

( * ) Notice: Subject to any disclaimer, the term of this patent is extended or adjusted under 35 U.S.C. 154(b) by 38 days.

(21) Appl. No.: 13/595,809

(22) Filed: Aug. 27, 2012

(65) Prior Publication Data

US 2012/0322338 A1 Dec. 20, 2012

Related U.S. Application Data

(63) Continuation-in-part of application No. 29/423,827, filed on Jun. 5, 2012.

(51) Int. Cl.
*A47F 5/00* (2006.01)

(52) U.S. Cl.
USPC ..... 248/229.16; 248/220.41; 248/231.81; 248/558; 224/666; 24/3.12; 24/3.9

(58) Field of Classification Search
CPC ..... A63H 3/50; A45F 5/02; A45F 5/021; A47G 23/0225
USPC ..... 248/229.16, 316, 220.31, 220.41, 248/231.81, 229.26, 558; 446/73, 28; 224/269, 666, 197; 24/3.1, 3.12, 3.9, 24/335, 669
See application file for complete search history.

(56) References Cited

U.S. PATENT DOCUMENTS

| | | | | | |
|---|---|---|---|---|---|
| 451,097 | A | * | 4/1891 | Wilkinson | 211/74 |
| 2,807,431 | A | * | 9/1957 | McHale | 248/113 |
| 3,616,571 | A | | 11/1971 | Adickes | |
| 4,214,688 | A | * | 7/1980 | Griffin, Jr. | 224/197 |
| 4,460,147 | A | * | 7/1984 | Macbain | 248/542 |
| 4,697,780 | A | * | 10/1987 | Wenkman et al. | 248/558 |
| 4,825,590 | A | * | 5/1989 | Cullinane | 47/67 |
| 4,953,770 | A | * | 9/1990 | Bond, Sr. | 224/250 |
| 5,003,725 | A | | 4/1991 | Maddox | |
| D317,252 | S | * | 6/1991 | Rumpel | D8/395 |
| 5,137,242 | A | * | 8/1992 | Reath | 248/309.1 |
| 5,332,090 | A | * | 7/1994 | Tucker | 206/315.3 |
| 5,381,922 | A | * | 1/1995 | Gladman et al. | 220/481 |
| 5,398,820 | A | | 3/1995 | Kiss | |
| D358,691 | S | * | 5/1995 | Engle | D32/54 |
| D364,269 | S | * | 11/1995 | Sabosky | D3/207 |
| 5,507,460 | A | * | 4/1996 | Schneider | 248/225.21 |
| 5,542,636 | A | * | 8/1996 | Mann et al. | 248/229.26 |
| D375,453 | S | * | 11/1996 | Fleck | D8/395 |
| 5,609,415 | A | * | 3/1997 | Protz, Jr. | 362/396 |
| 5,651,522 | A | * | 7/1997 | Davis et al. | 248/221.11 |
| 5,669,709 | A | * | 9/1997 | Adams | 362/396 |

(Continued)

FOREIGN PATENT DOCUMENTS

WO 2007053632 A2 5/2007

*Primary Examiner* — Terrell McKinnon
*Assistant Examiner* — Daniel Breslin
(74) *Attorney, Agent, or Firm* — Jonathan Jaech; Novak Druce Connolly Bove + Quigg LLP

(57) ABSTRACT

Display article support systems and methods of using, interchangeable support clips, support elements and display boards for support of display articles such as dolls for display, transport and/or play are disclosed. A kit includes a variety of the interchangeable support clips and support elements included in a package.

17 Claims, 29 Drawing Sheets

(56) References Cited

U.S. PATENT DOCUMENTS

| | | | | | |
|---|---|---|---|---|---|
| 5,730,638 | A | | 3/1998 | Ward | |
| 5,772,166 | A | * | 6/1998 | Adams | 248/231.81 |
| 5,857,601 | A | * | 1/1999 | Greenwood | 224/409 |
| D415,343 | S | * | 10/1999 | Maddox | D3/215 |
| 6,045,017 | A | * | 4/2000 | Connell | 224/148.7 |
| 6,056,253 | A | * | 5/2000 | Tripp | 248/213.2 |
| D431,337 | S | * | 9/2000 | King | D32/54 |
| 6,189,847 | B1 | * | 2/2001 | Hart | 248/220.31 |
| 6,484,365 | B1 | * | 11/2002 | Thompson | 24/3.12 |
| D471,709 | S | * | 3/2003 | Coyne | D3/266 |
| 6,575,302 | B2 | | 6/2003 | Robley, Jr. | |
| 6,691,374 | B2 | * | 2/2004 | Coyne | 24/3.3 |
| D495,944 | S | * | 9/2004 | Winig et al. | D8/367 |
| D545,183 | S | * | 6/2007 | French et al. | D8/394 |
| 7,241,071 | B2 | * | 7/2007 | Carraher et al. | 403/164 |
| 7,267,254 | B2 | * | 9/2007 | Perez | 224/666 |
| D552,462 | S | * | 10/2007 | Boyd et al. | D8/395 |
| D552,463 | S | * | 10/2007 | French et al. | D8/395 |
| D562,676 | S | * | 2/2008 | Cox et al. | D8/395 |
| 7,398,951 | B1 | * | 7/2008 | Sugalski et al. | 248/311.2 |
| D600,077 | S | * | 9/2009 | Barnes, Jr. | D7/620 |
| D600,544 | S | * | 9/2009 | Klaus et al. | D8/395 |
| 7,748,583 | B1 | * | 7/2010 | Woltman | 224/251 |
| 7,926,149 | B2 | * | 4/2011 | Weston | 24/3.12 |
| 7,997,773 | B2 | * | 8/2011 | Kraus et al. | 362/396 |
| 8,091,845 | B2 | * | 1/2012 | Di Lollo | 248/213.2 |
| 8,231,094 | B1 | * | 7/2012 | Barnes, Jr. | 248/311.2 |
| D669,773 | S | * | 10/2012 | Colasse | D8/395 |
| D671,826 | S | * | 12/2012 | Adams et al. | D8/395 |
| D680,857 | S | * | 4/2013 | Rumpel | D8/395 |
| D695,098 | S | * | 12/2013 | Hobson | D8/395 |
| 2004/0004169 | A1 | * | 1/2004 | Hays | 248/229.16 |
| 2004/0159756 | A1 | * | 8/2004 | Albertson | 248/227.1 |
| 2004/0195284 | A1 | | 10/2004 | Iitsuka | |
| 2005/0051678 | A1 | | 3/2005 | Modesto | |
| 2010/0254123 | A1 | * | 10/2010 | Brown | 362/191 |
| 2011/0248060 | A1 | * | 10/2011 | Luk et al. | 224/567 |

* cited by examiner

DISPLAY ARTICLE SUPPORT SYSTEMS

CROSS-REFERENCE TO RELATED APPLICATION

This application is a continuation-in-part of U.S. application Ser. No. 29/423,827 filed Jun. 5, 2012, the entirety of which is specifically incorporated herein by reference.

FIELD

The present disclosure relates to display article support systems, kits, and devices and methods for mounting dolls, play figures, and other types of articles for display, transport and/or play.

BACKGROUND

Positioning dolls and other types of play figures in an upright position for display, transport, and play may pose difficulties for various reasons. For example, dolls used for play, e.g. BARBIE® and BRATZ® dolls, are often not manufactured with legs capable of supporting the doll in a freestanding position. To display a doll in a freestanding upright position, manual support or positioning against a vertical surface may be necessary. A collector of dolls may, for example, have several dolls positioned against the back wall of a bookshelf. Nonetheless, display of dolls in this manner may not be aesthetically pleasing to many collectors. In addition, even freestanding dolls require a horizontal surface to stand upright, and sufficient horizontal display space may be unavailable for many users or collectors of dolls. Further problems may arise when transporting dolls from place to place. Traditionally, dolls may be handheld or placed in a bag for carrying, but transporting dolls in these ways may interfere with upright display of a doll or tie up a users hands.

Known display stands which place dolls in an upright position are often coupled to a doll's legs. Sometimes these stands have a base that partially fixes one or more legs of the doll for upright positioning. Although useful for their intended purpose, display stands of this type have several limitations. Like freestanding dolls, such stands require adequate horizontal display space for use. Many stands are made from metallic based materials, which are capable of scratching support surfaces. In addition, these types of display stands are often not suited for easy transport. Stands can add significant weight and bulk to bags used to carry dolls. Moreover, from a child's perspective, stands may also interfere with positioning of dolls and distract from the overall play experience.

Considering the limitations of display stands and other products proposed for positioning of dolls and play figures, there is a clear need for improved display article support systems, kits, devices and methods of mounting display articles. The present invention fulfills these needs and provides further related advantages, as described in the following summary.

SUMMARY

The present invention is directed to display article support systems, kits, devices and methods for supporting or mounting a doll, play figure, or other type of display article. As used herein, a system may include assemblies, or collections of unassembled components configured for assembly. The support systems disclosed herein each include a C-shaped support, having opposing arcuate arms that extend from a medial portion for support of a doll, play figure, or other type of display article. The C-shaped support also includes an engagement mechanism that is coupled to a medial portion. The engagement mechanism is configured to removably couple with various types of support or mounting elements configured to support a display article. The system may further include a doll, play figure, or other article, which is held in place by the C-shaped support. The C-shaped support may, for example, engage with the torso of a play figure or other area on a play figure, e.g. a doll's neck, which is suitable for engagement.

A display article support kit can include a package, a C-shaped support enclosed by the package, and at least one item selected from a support clip or a plate-shaped support element, where each of the items include portions of the engagement mechanism for coupling to the C-shaped support. In addition, a kit may also include one or more dolls, play figures or display articles enclosed in the package.

A method for mounting a display article can include the steps of placing a C-shaped support around the display article, where the C-shaped support comprises opposing arcuate arms extending from a medial portion of the support and a first mating portion of an engagement mechanism; selecting a mounting device from a support clip, a plate-shaped support element, and a display board, wherein the mounting device comprises a second mating portion of the engagement mechanism configured for coupling to the C-shaped support; coupling the mounting device to the C-shaped support; and mounting the display article to a freestanding structure, a surface, a person, or an animal using the mounting device.

Accordingly, display article support systems, kits, devices, and methods of mounting one or more dolls, play figures, and other articles are disclosed. A more complete understanding of the systems, kits, devices, and methods disclosed herein will be afforded to those skilled in the art, as well as a realization of additional advantages and objects thereof, by consideration of the following detailed description. Reference will be made to the appended sheets of drawings which will first be described briefly.

BRIEF DESCRIPTION OF THE DRAWINGS

The drawings described herein are for illustrative purposes and are not intended to limit the scope of the present disclosure. Like element numerals are used to indicate like elements appearing in one or more of the figures.

DETAILED DESCRIPTION

Turning in detail to the drawings, FIGS. 1-48 shows various configurations of display article support systems and system elements which are used to support, display, and mount articles such as dolls, play figures, memorabilia and other types of small decorative display articles.

Figure 1:
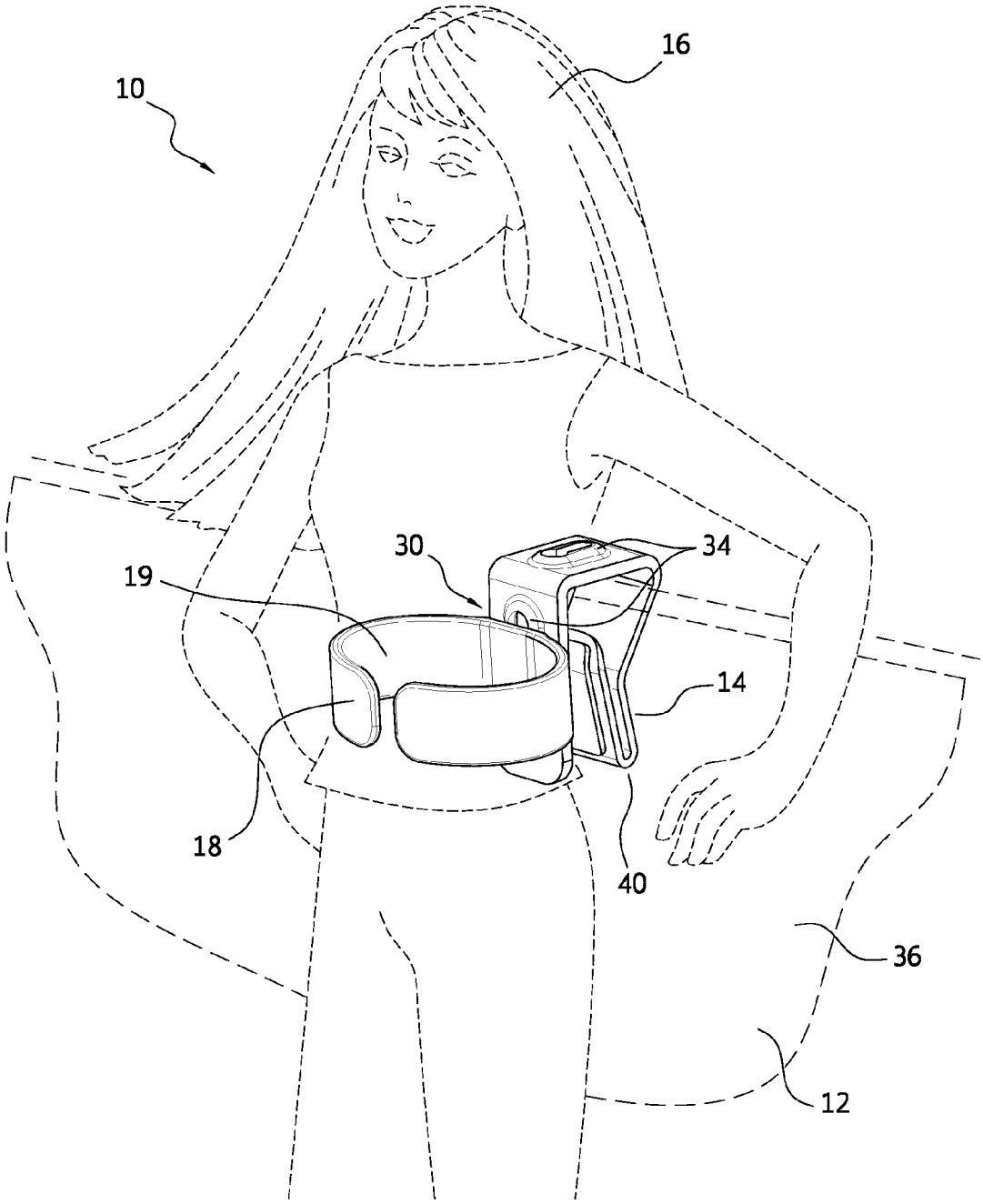
FIG. 1 is a perspective view of a display article support system oriented on a substantially vertical surface.

The following discussion relates generally to FIGS. 1-13, which show different views of the components and assemblies of the display article support system shown in FIG. 1. FIG. 1 shows a perspective view of one configuration of a display article support system 10 oriented on a surface 12 with a display article 16. Each type of display article support system disclosed herein includes a mounting device 14 and a C-shaped support 18, having opposing arcuate arms 20, 22 (FIG. 2), which extend from a medial portion 24 (FIG. 2) for support of a display article 16.

The C-shaped support 18 may be placed on display articles having a neck, waist, or similarly configured portion suitable for being securely grasped by the opposing arcuate arms 20, 22. Display articles can therefore include articles such as dolls, play figures (e.g. action figures), plush toys, and similar display articles having an indented section 19 (e.g. a waist or neck on a play figure) or a deformable section such that the article can be securely held by the C-shaped support for static display, transport, or play.

Figure 2:
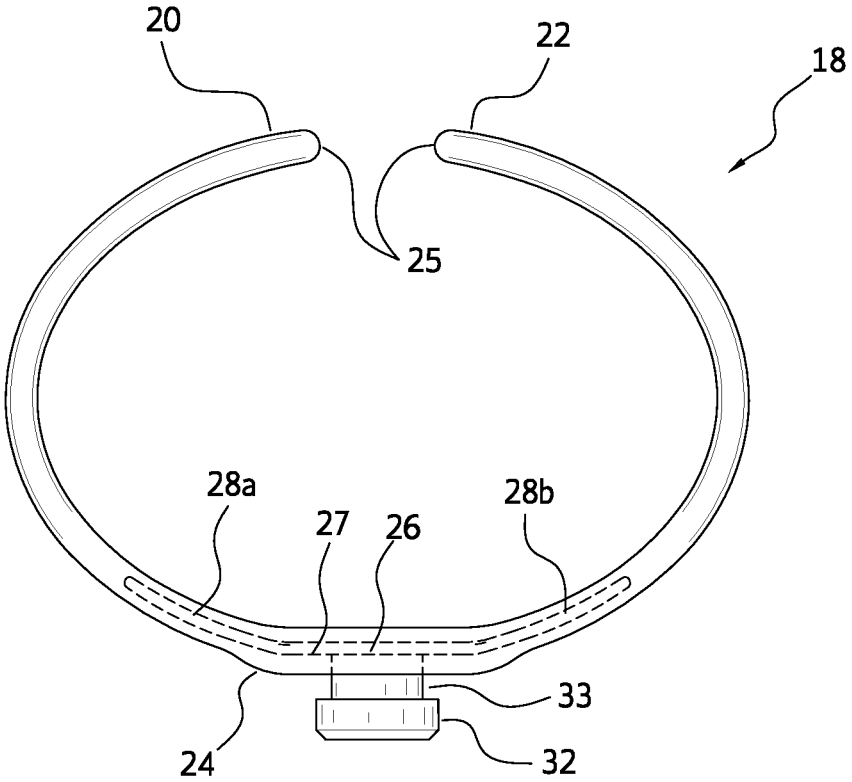
FIG. 2 is a top view of a C-shaped support.
Figure 3:
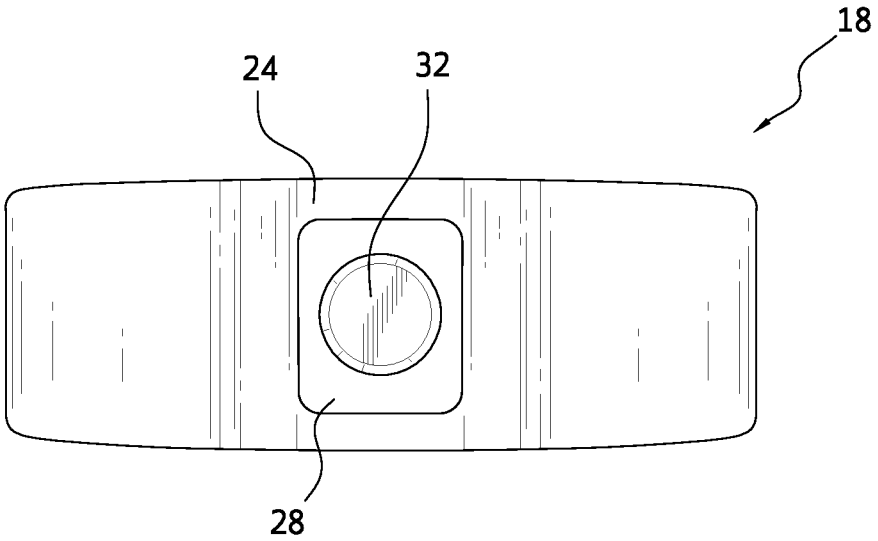
FIG. 3 is a rear view of the C-shaped support shown in FIG. 2.

FIGS. 2 and 3, respectively, show top and rear views of the C-shaped support 18. The C-shaped support 18 includes opposing arcuate arms 20, 22, a medial portion 24 and a resilient inner support 26 disposed within the medial portion and at least a portion of each arcuate arm. An overmolding process may be used to form the opposing arcuate arms 20, 22 and the medial portion 24 over the resilient inner support 26, for example. The inner support 26 may include a central section 27, arcuate sections 28*a*, 28*b*, which extend into each arcuate arm 20, 22, and a first mating portion 32.

In yet another embodiment, the C-shaped support may include one or more connectors (not shown) that facilitate closure of the support at the ends 25 of the arcuate arms. Connector types may include opposite pole magnets, buckles, clip arrangements, snap, clasps, hook and loop type elements, adhesive elements and/or a combination of these or other types of connectors.

Arcuate sections 28*a*, 28*b* and the central section 27 may be integrally molded and integrally coupled to the first mating portion 32. In the alternative, the first mating portion 32 may also be inserted into the central section 27 using any coupling method. The first mating portion 32 is not necessarily limited to a button-like shape, having a neck 33, as shown in FIG. 2.

The first mating portion may have any shape that complements a second mating portion 34 to form the engagement mechanism 30.

Arcuate arms 20, 22 and the medial portion 24 of the C-shaped support 18 may be manufactured from one or more resilient materials such that each arm can withstand repeated deformation. Such deformation will typically occur during insertion, removal, and/or positioning of an article within the C-shaped support. Suitable materials for the C-shaped support should be resilient and flexible, and have substantial shape memory. Such materials may include, for example, spring steel or other metallic based materials, structural plastics, composites, and elastomers, including, but not limited to neoprene, silicone, and styrene butadiene rubbers having about 80 to about 90 durometer, Shore A. In one configuration of the C-shaped support, each arm has an average material thickness ranging from about 0.115 inches to about 0.150 inches.

The inner support 26 may be manufactured from a resilient material having mechanical properties sufficient to withstand frequent removal and positioning of the first mating portion onto a second mating portion. Materials may therefore include steel or other metallic-based materials, composites, ceramics, and structural plastics including acrylonitrile butadiene styrene (ABS).

Each type of support system may also include an engagement mechanism 30 which includes the first mating portion 32 and a second mating portion 34. The engagement mechanism, therefore, includes mating portions 32, 34 for coupling of the C-shaped support 18 to a mounting device 14. The engagement mechanism 30 may be any type of coupling that facilitates attachment of the C-shaped support for support or mounting of a display article 16. A coupling may therefore include mating elements types that are twist-activated, snap-activated, post-and-slot type, hook and-loop type, and similar convenience fasteners for coupling non-critical parts under light loads. The engagement mechanism 30 may be configured to removably couple with various types of mounting devices 14 including, support clips, plate-shaped support elements, display boards, and other types of mounting devices configured to support a display article, as further described below. Each of type of mounting device 14 includes one or more second mating portions 34, which are each configured to couple with a first mating portion 32 to form the engagement mechanism 30. Support systems may further include a display article 16 such as a doll, action figure, plush toy, or other display figure, which is held in place by the C-shaped support.

Figure 14:
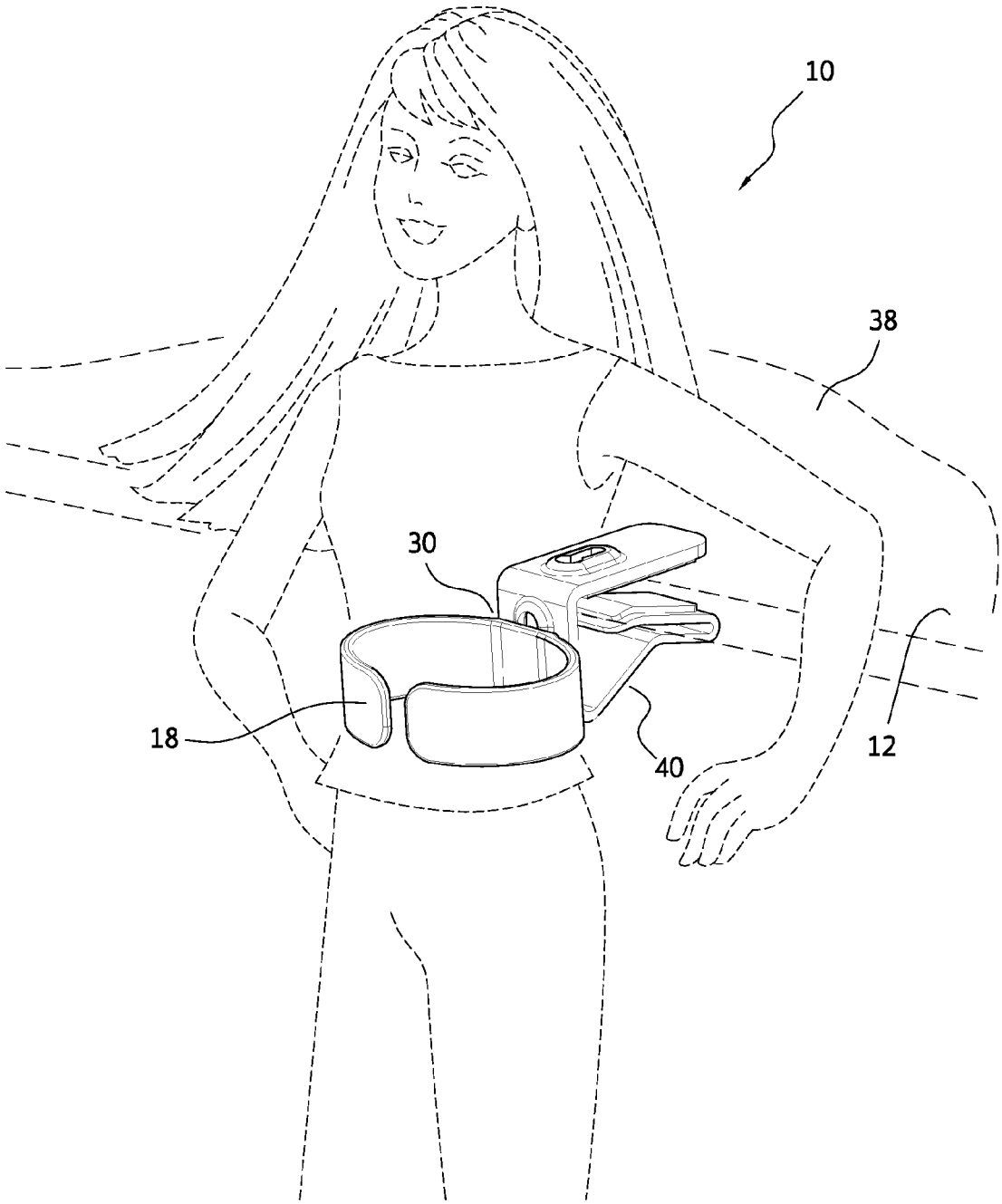
FIG. 14 is a perspective view of the display article support system shown in FIG. 1, turned to orient on a substantially horizontal surface.
Figure 15:
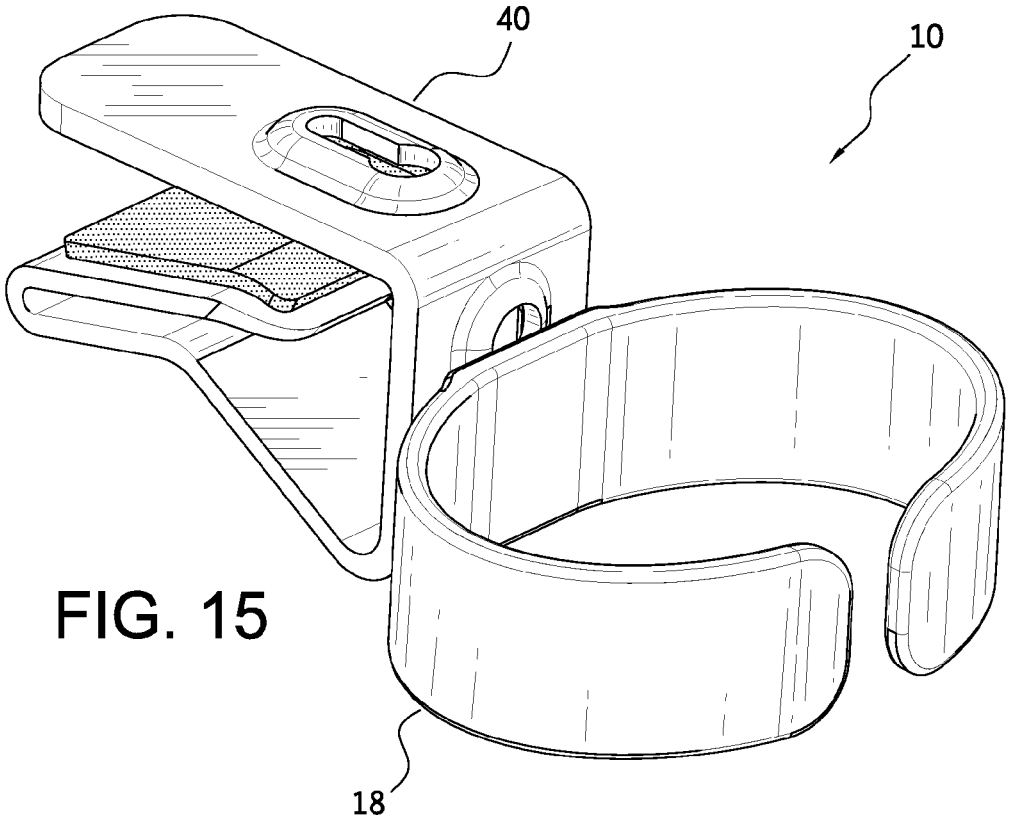
FIG. 15 is a perspective view of the display article support system shown in FIG. 14.
Figure 16:
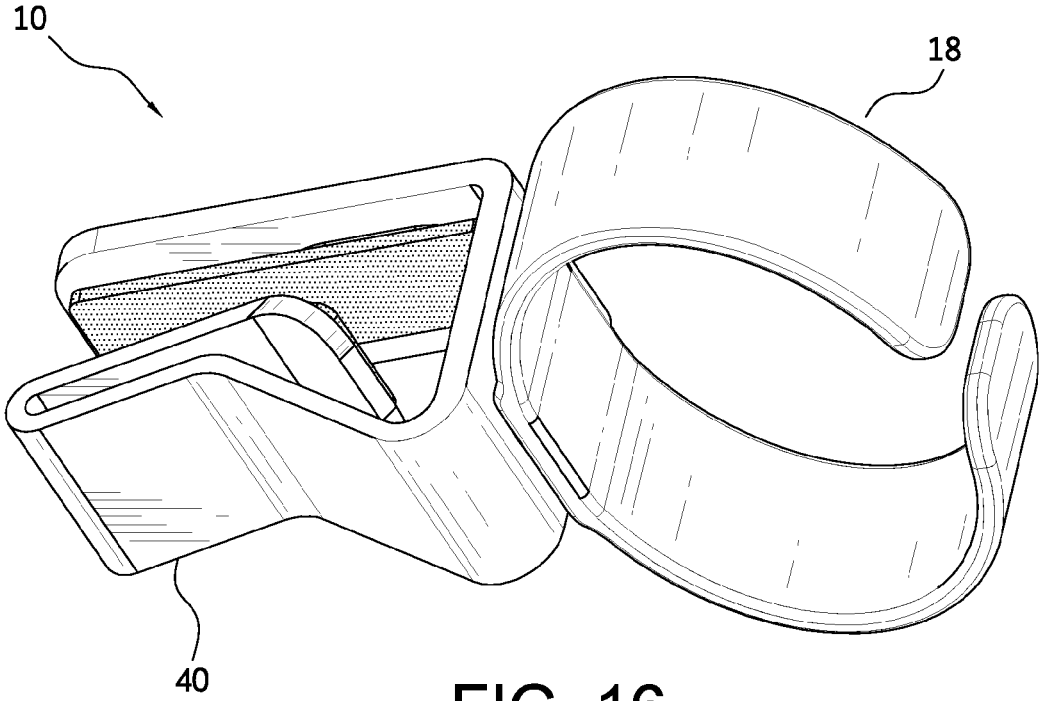
FIG. 16 is another perspective view of the display article support system shown in FIG. 14.

FIGS. 1 and 14, respectively, show perspective views of one type of display article support system 10, which includes a dual-orientation support clip 40 configured for multiple orientations. In a first orientation, shown particularly in FIGS. 1 and 6-13, the support system 10 may be oriented to support a display article 16 on a substantially vertical surface 36 (FIG. 1). In a second orientation, shown particularly in FIGS. 14-22, the system 10 may be oriented to support a display article 16 on a substantially horizontal surface 38 (FIG. 14). For both orientations such surfaces include, but are not limited to decorative articles and indoor and outdoor furniture such as chairs, bed frames, head boards, fences, book shelves, tables, etc.

Dual-orientation support clips 40 may be manufactured from one or more resilient materials such that clips can withstand repeated positioning on and off support surfaces. Support-clip materials may therefore include elastomers, ceramics, composites, structural plastics such as ABS and polystyrene. In one configuration, a support clip has an average material thickness of about 0.110 inches.

Figure 4A:
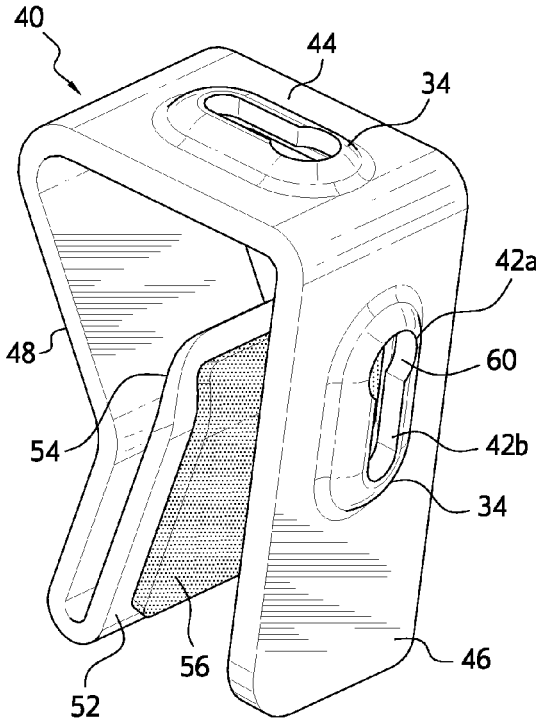
FIG. 4A is a front perspective view of a support clip positioned for orientation on a substantially vertical surface.
Figure 4B:
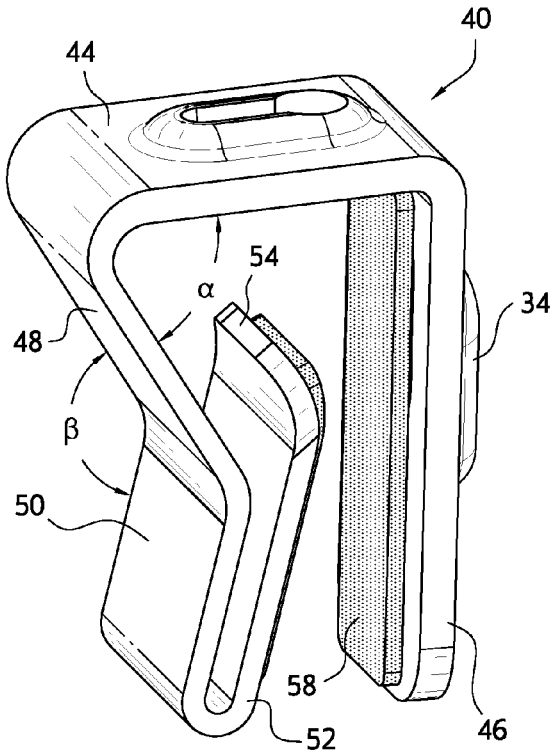
FIG. 4B is rear perspective view of the support clip shown in FIG. 4*a*.
Figure 5:
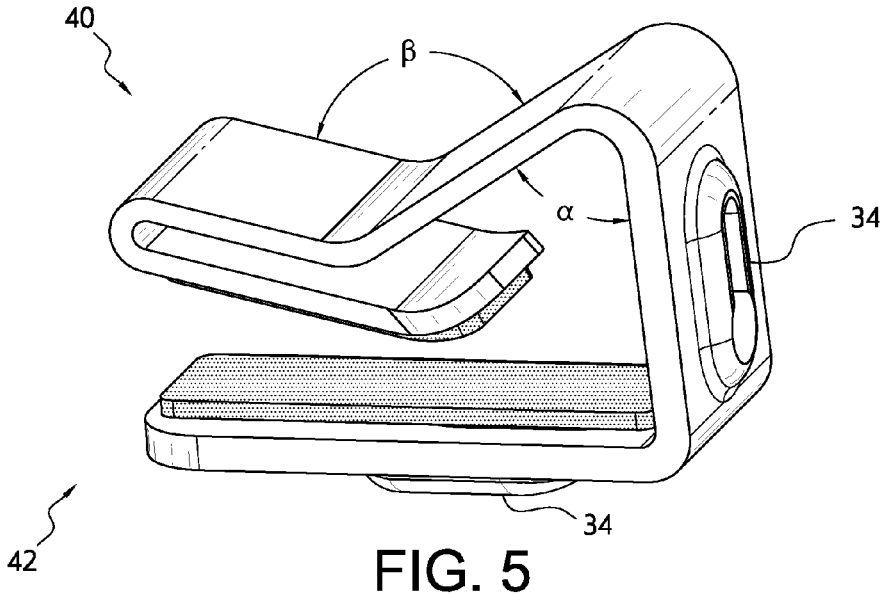
FIG. 5 is a perspective view of the support clip shown in FIG. 4*b* positioned for orientation on a substantially horizontal surface.
Figure 6:
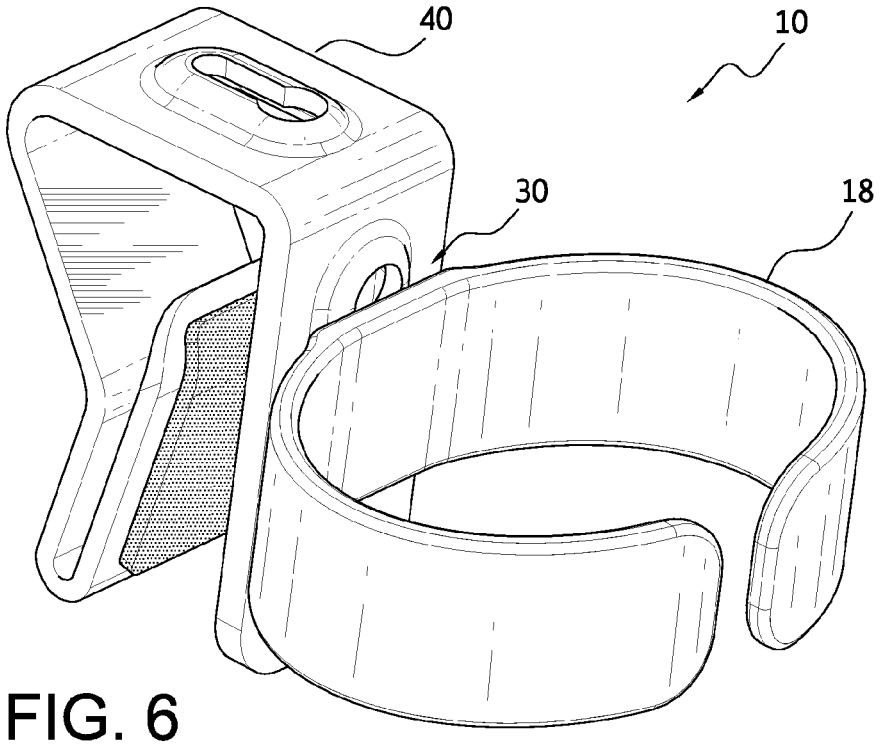
FIG. 6 is a perspective view of the display article support system shown in FIG. 1.
Figure 7:
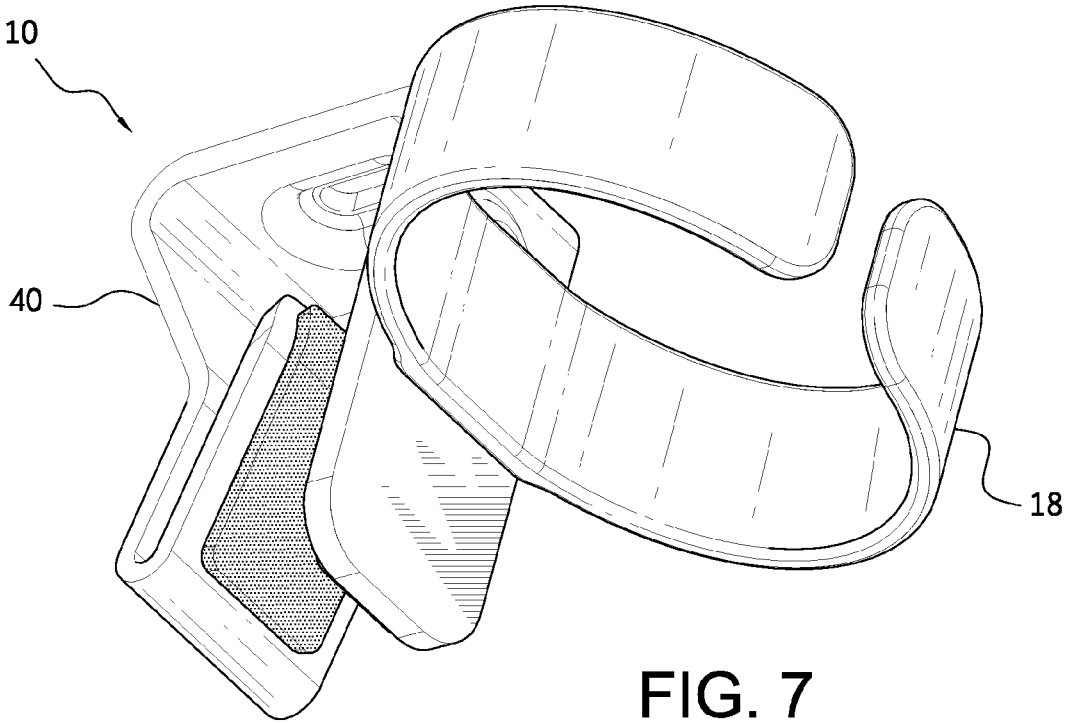
FIG. 7 is another perspective view of the display article support system shown in FIG. 1.
Figure 8:
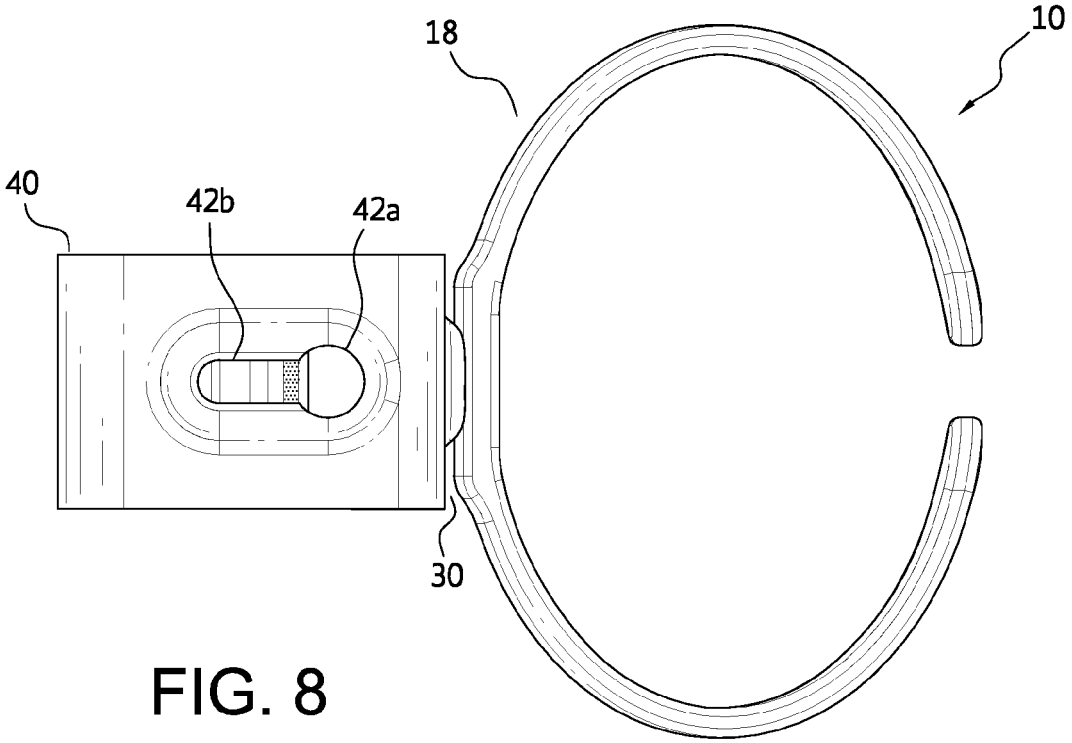
FIG. 8 is a top elevation view of the display article support system shown in FIG. 1.
Figure 9:
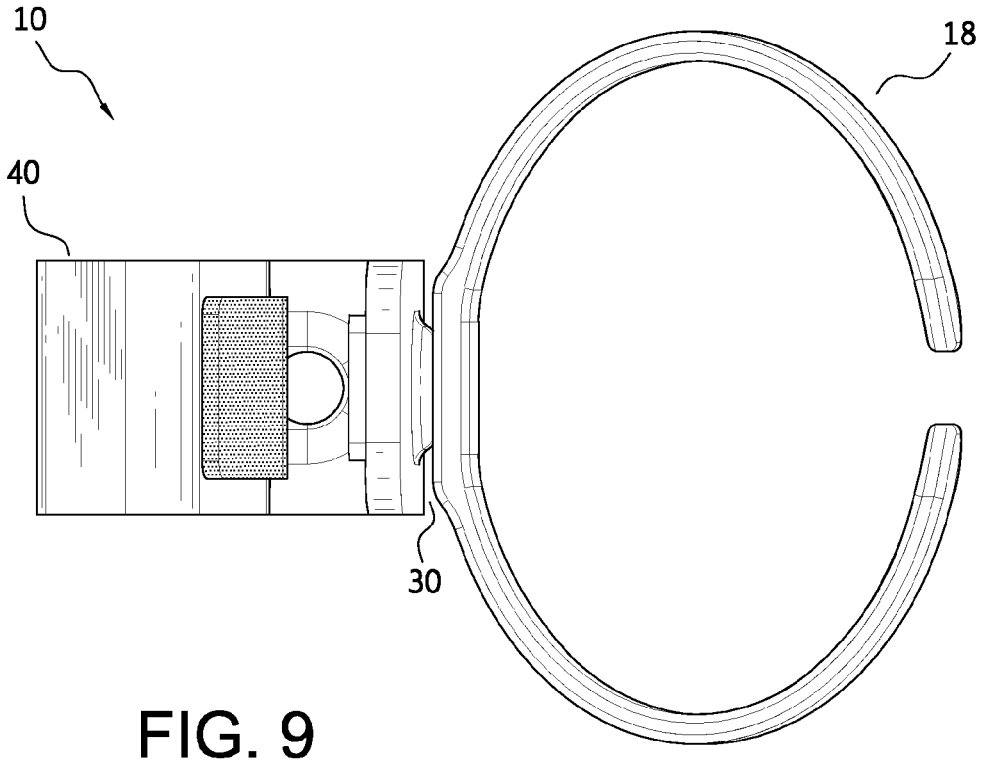
FIG. 9 is a bottom elevation view of the display article support system shown in FIG. 1.
Figure 10:
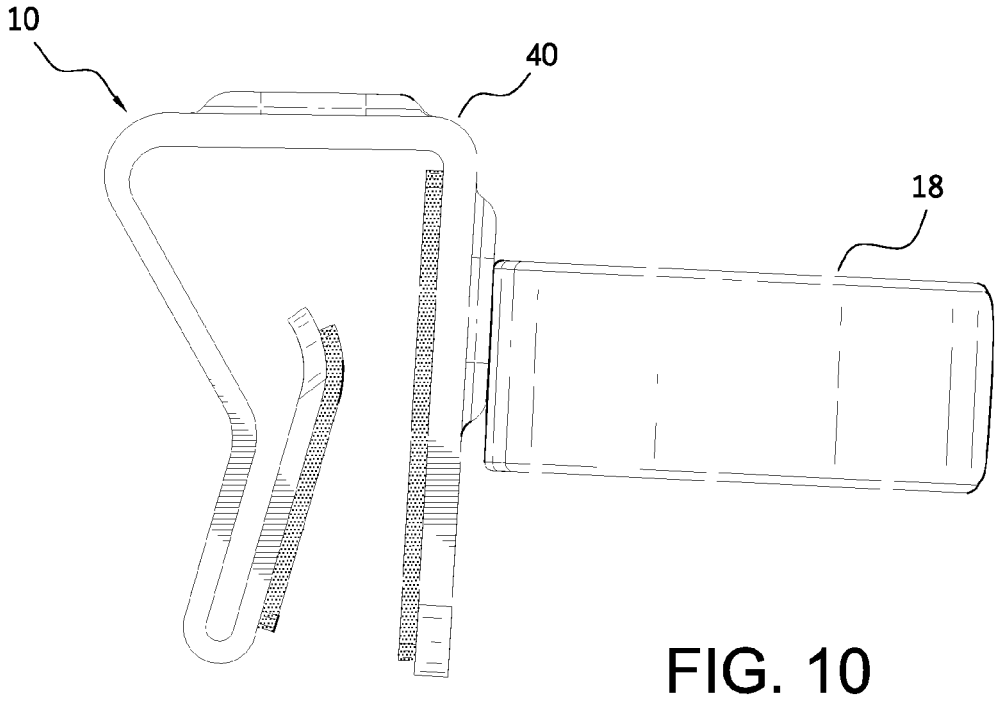
FIG. 10 is a right side elevation view of the display article support system shown in FIG. 1.

FIGS. 4A, 4B, and 5 show different orientations of the support clip 40 before attachment to the C-shaped support. The support clip 40 includes a first support arm 44 and a second support arm 46 configured to position a display article on either a substantially horizontal or vertical surface. In this configuration of the support clip, the first support arm 44 extends at a right angle with respect to the second support arm 46. The support clip also includes multiple segments that facilitate attachment of the clip to various types of surfaces. The support clip 40 also includes a first segment 48 that extends at an acute angle, a, with respect to the first support arm 44, a second segment 50 that extends at an obtuse angle, b, with respect to the first segment 48, and a third segment 52, which is inwardly bent towards the second support arm 46. A fourth segment 54 having a slight curve may also be included on the support clip.

Figure 11:
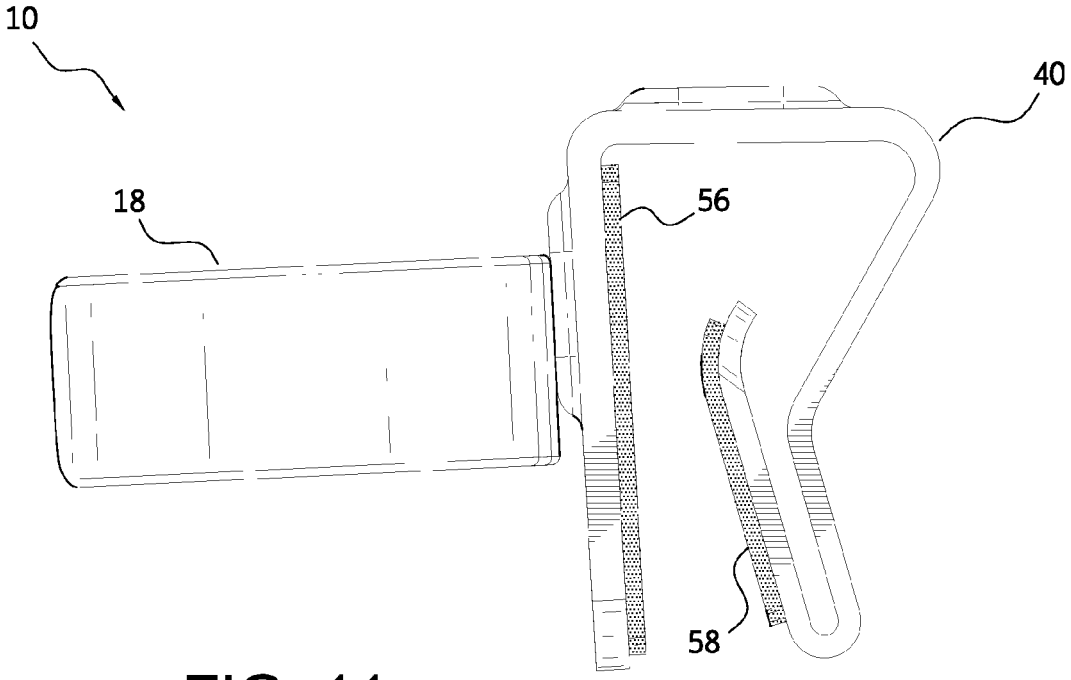
FIG. 11 is a left side elevation view of the display article support system shown in FIG. 1.
Figure 12:
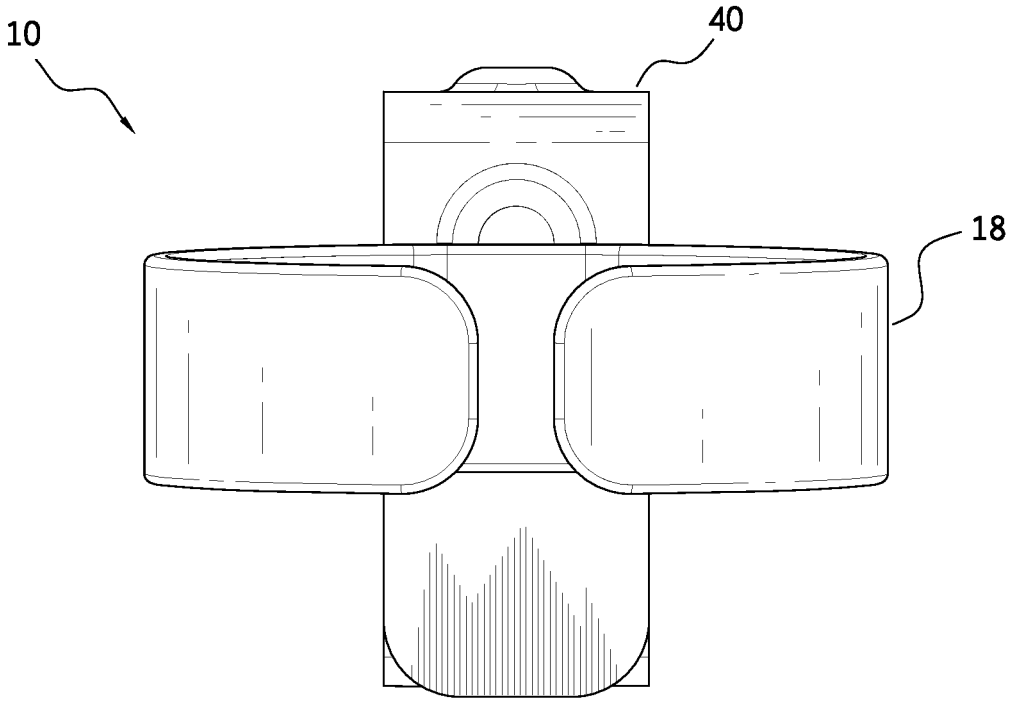
FIG. 12 is a front elevation view of the display article support system shown in FIG. 1.
Figure 13:
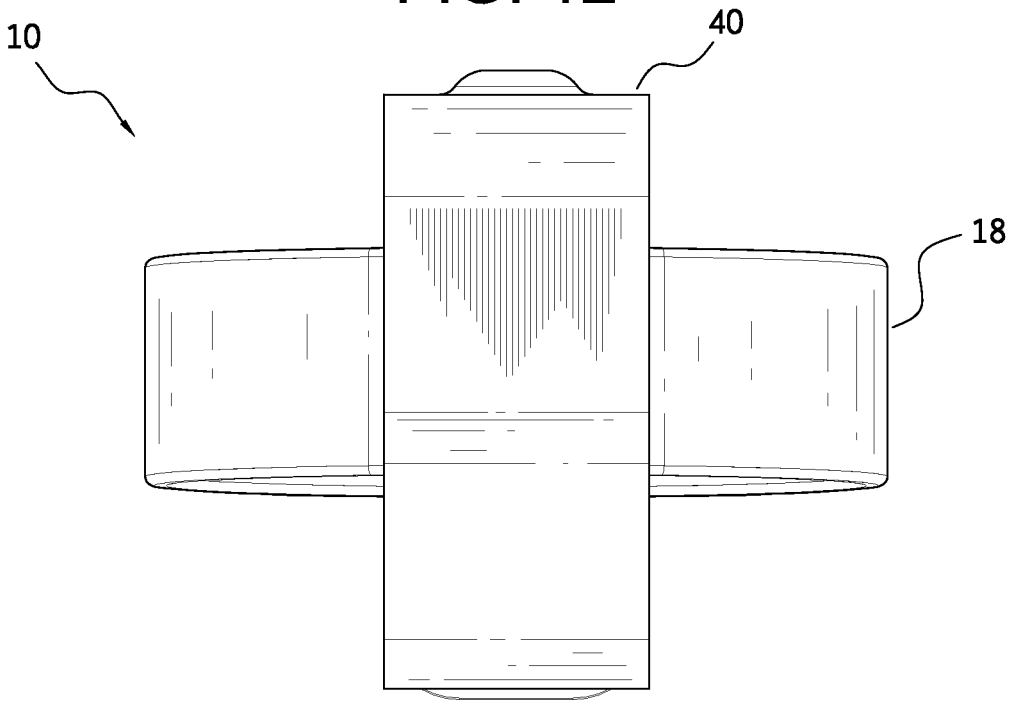
FIG. 13 is a rear elevation view of the display article support system shown in FIG. 1.

To facilitate gripping of a support clip 40 to a surface, gripping elements 56, 58 may be affixed to one or more segments, as shown in FIG. 11. These gripping elements may be manufactured from one or more elastomeric materials, including neoprene and comparable elastomers. Preferably, the material types include those that are adhesive-backed or have surface properties suitable for adhesives and those which minimize damage (e.g. scratches) to support surfaces.

Figure 17:
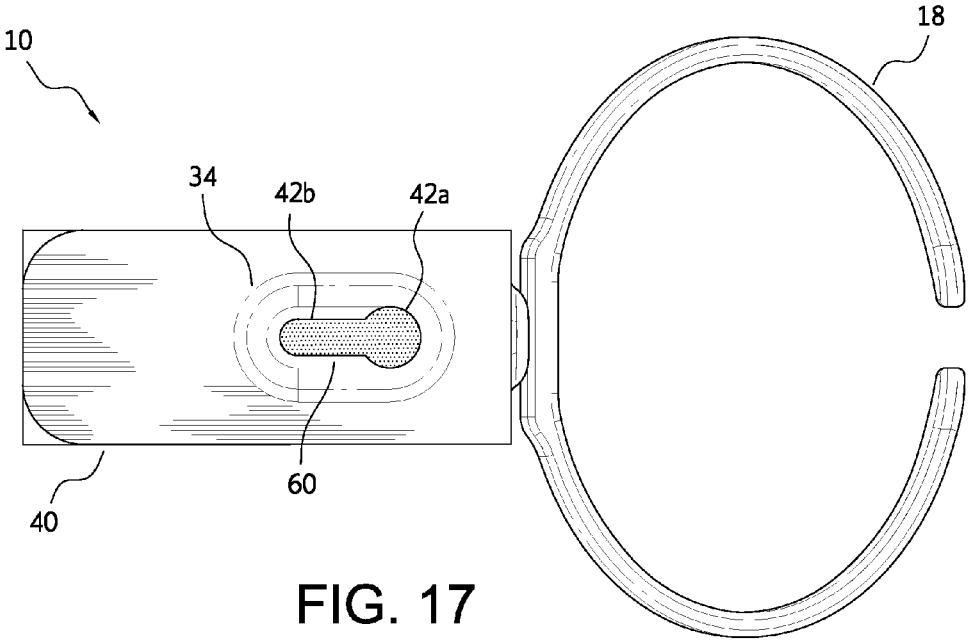
FIG. 17 is a top elevation view of the display article support system shown in FIG. 14.
Figure 18:
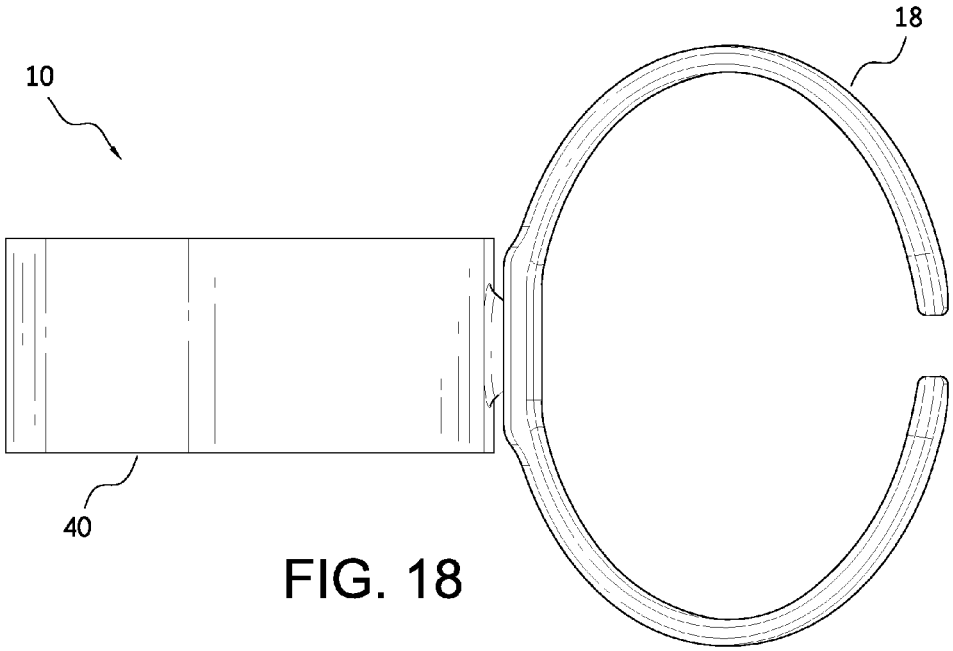
FIG. 18 is a bottom elevation view of the display article support system shown in FIG. 14.
Figure 19:
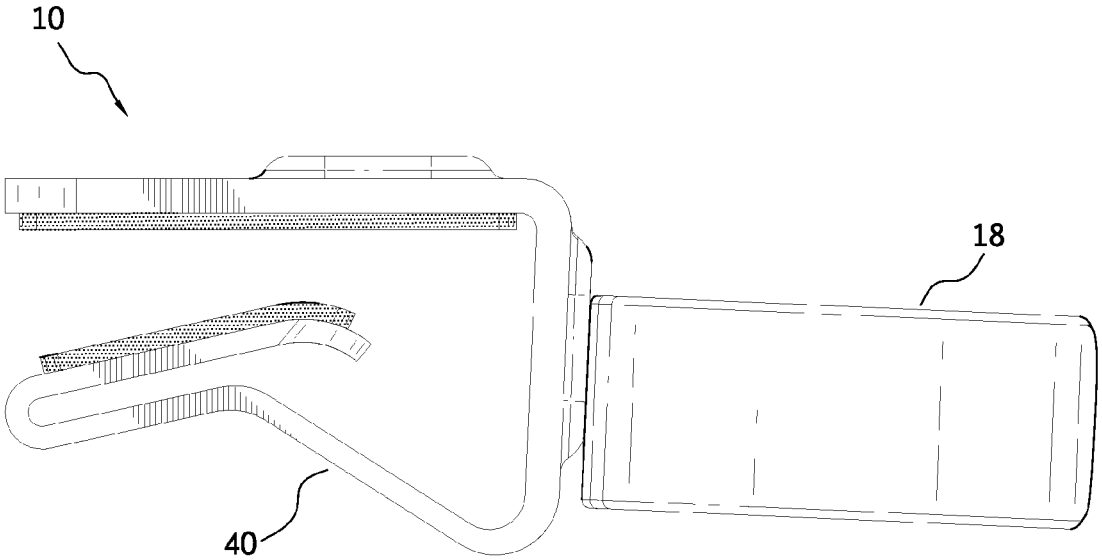
FIG. 19 is a right side elevation view of the display article support system shown in FIG. 14.
Figure 20:
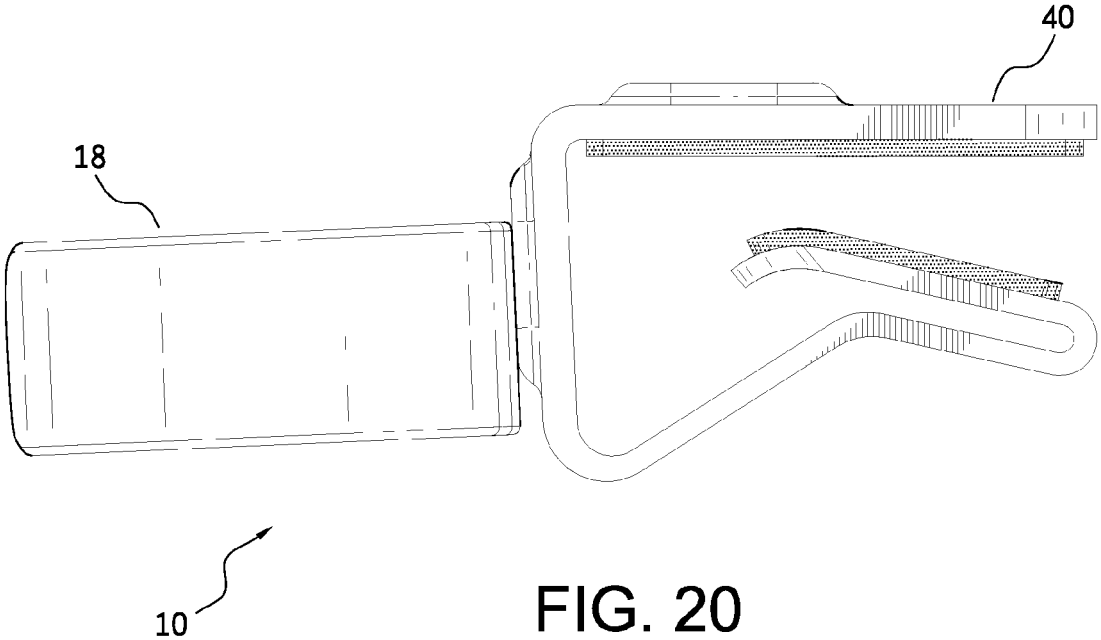
FIG. 20 is a left side elevation view of the display article support system shown in FIG. 14.
Figure 21:
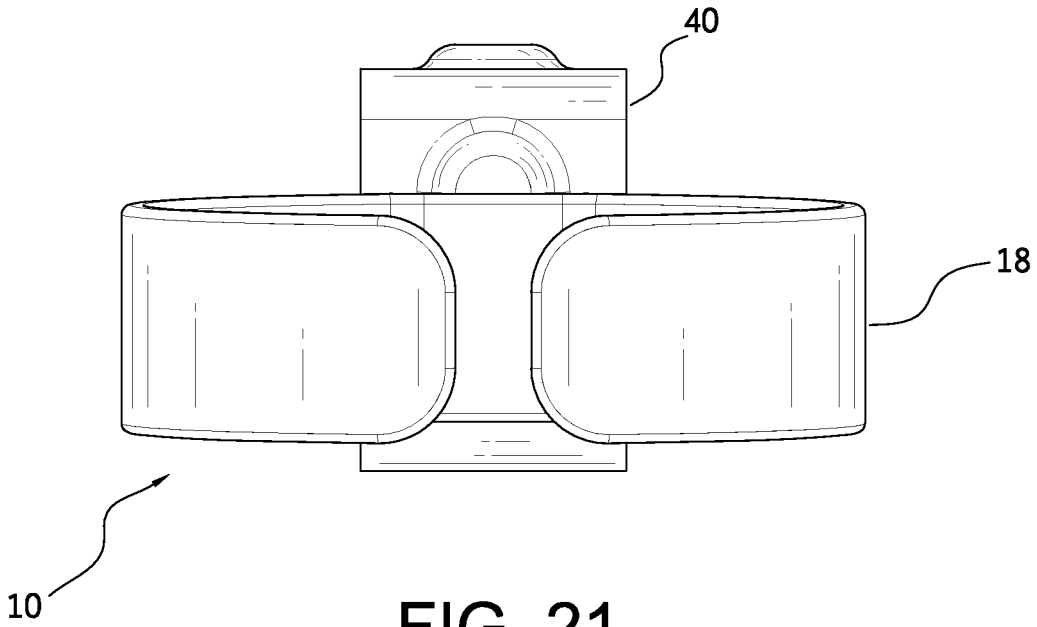
FIG. 21 is a front elevation view of the display article support system shown in FIG. 14.
Figure 22:
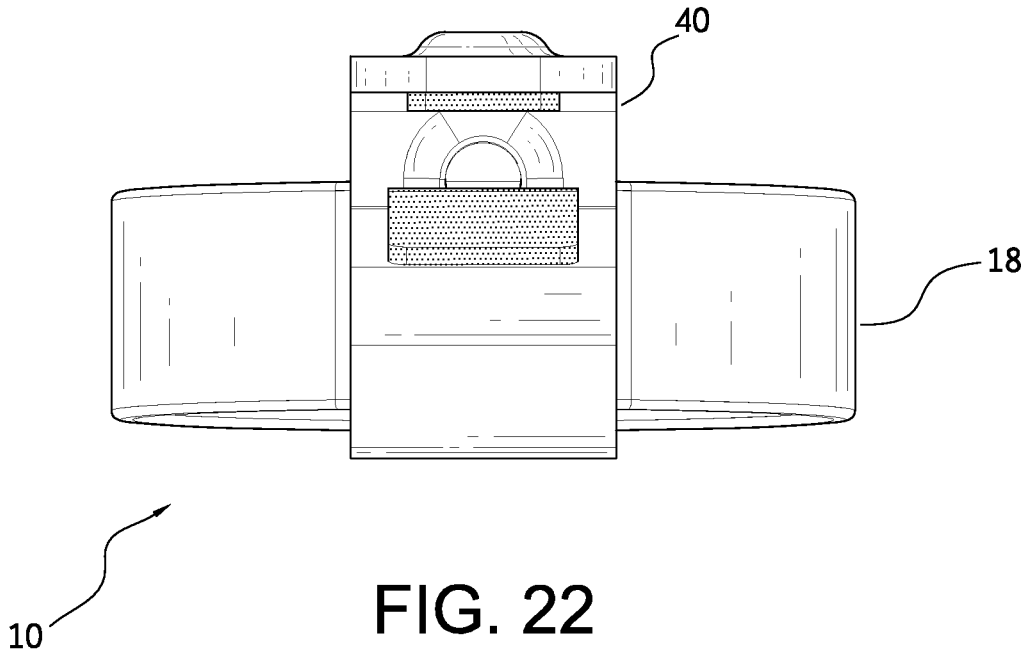
FIG. 22 is a rear elevation view of the display article support system shown in FIG. 14.

One or more second mating portions 34 are included on the support clip 40 for mounting of the C-shaped support 18, as shown in FIGS. 4A and 17. A second mating portion 34 may be configured with a slotted area 60 such that the first mating portion 32 fits into the slotted area. The slotted area may include an upper section 42*a* and a lower section 42*b*, where the upper section has a slightly large outer area for insertion of the first mating element. Upon insertion of the first mating element, the first mating portion may be adjusted such that the first mating element is securely positioned, using a twist and lock mechanism, for example. The second mating portion 34 may also have a key-hole shape such that C-shaped support is securely positioned onto the support clip 40, as shown in FIG. 1, and FIGS. 6-22

Figure 23:
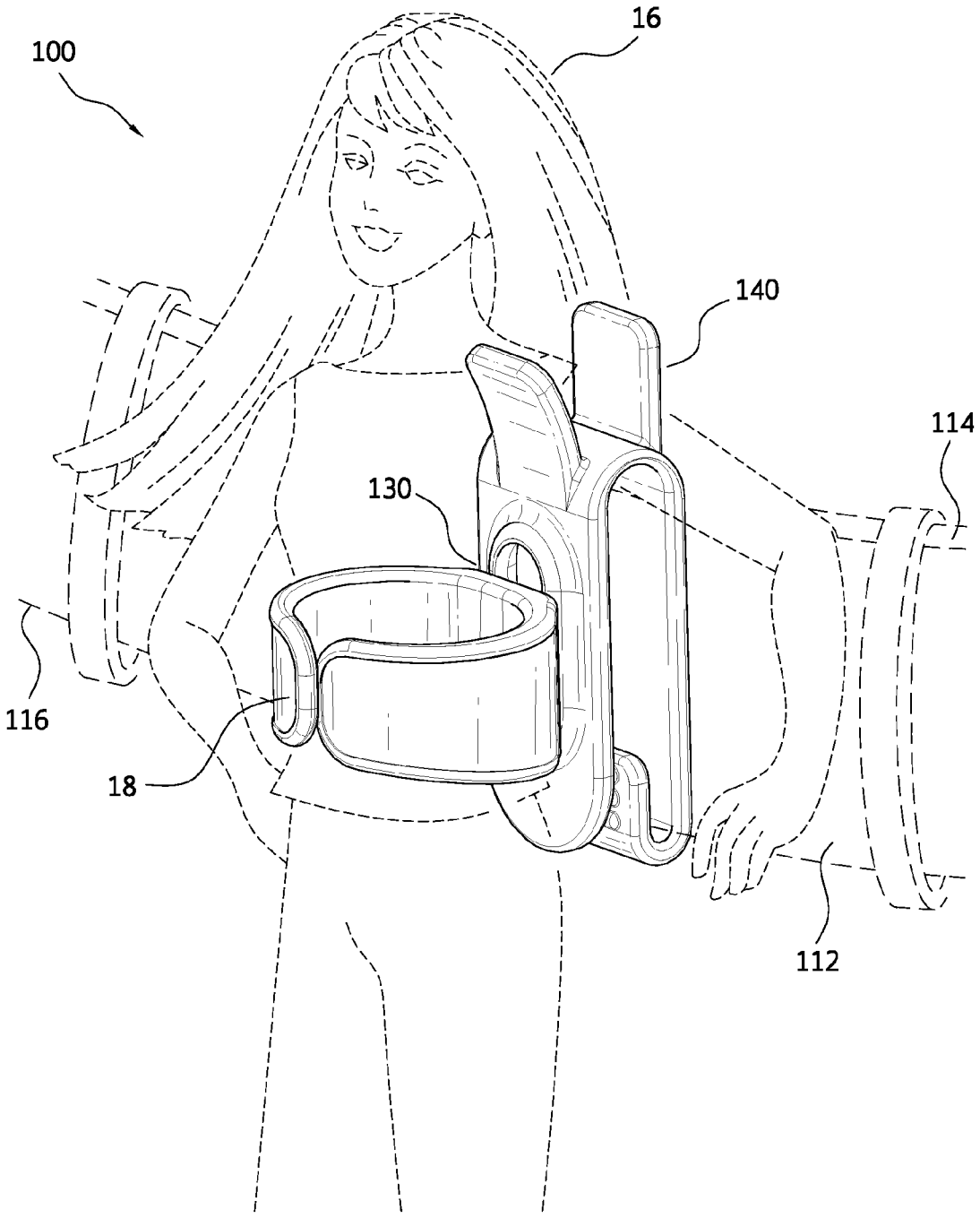
FIG. 23 is a perspective of another embodiment of a display article support system, positioned on a strap or other similar surface.
Figure 24:
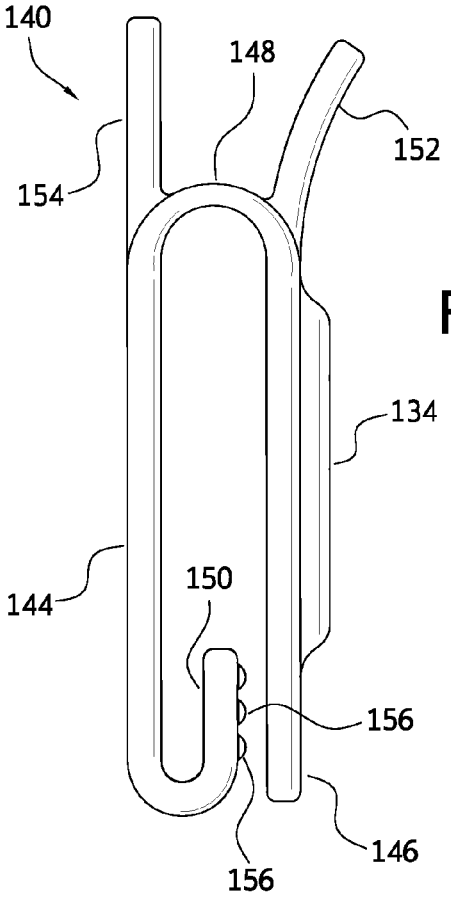
FIG. 24 is a side view of a u-shaped support clip.
Figure 25:
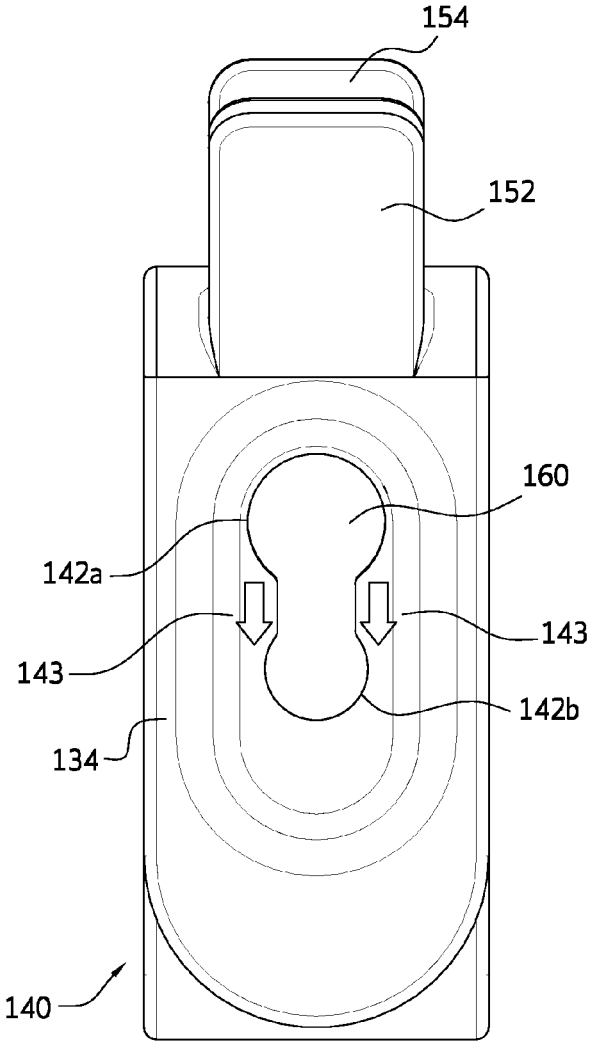
FIG. 25 is a rear view of the u-shaped support clip shown in FIG. 24.
Figure 26:
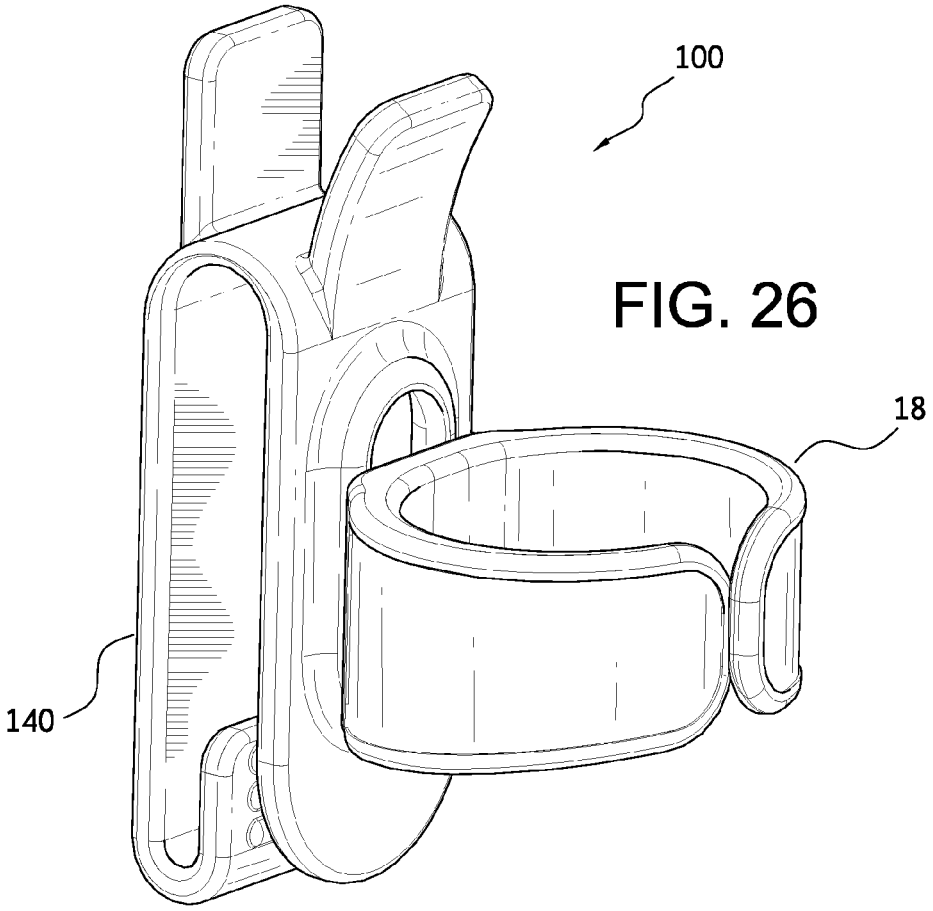
FIG. 26 is a perspective view of the display article support system shown in FIG. 23.
Figure 27:
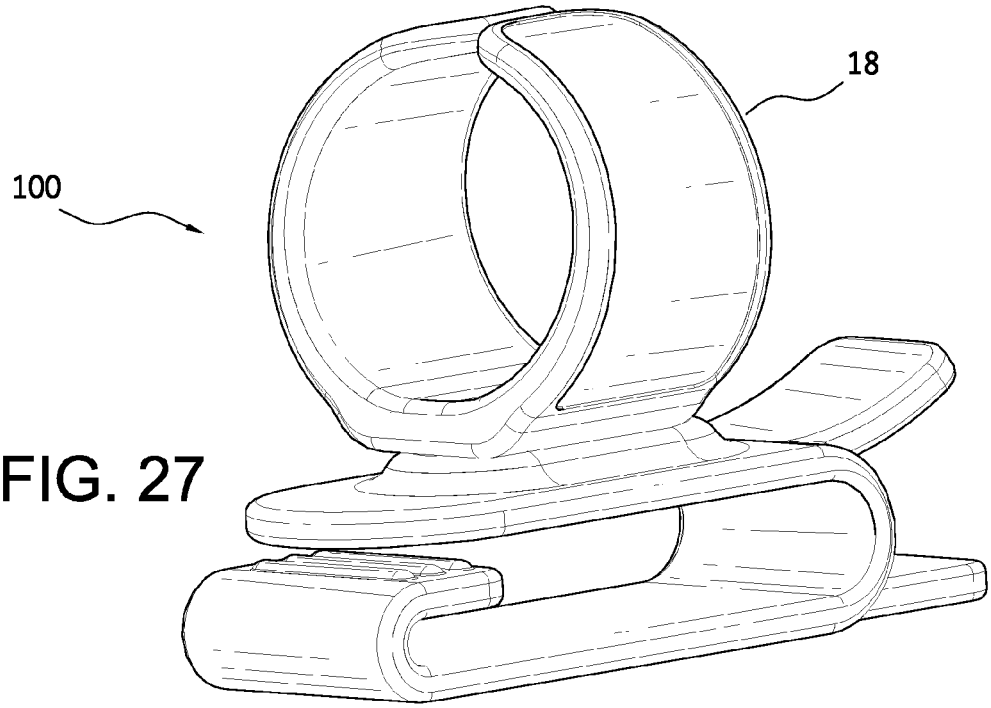
FIG. 27 is another perspective view of the display article support system shown in FIG. 23.
Figure 28:
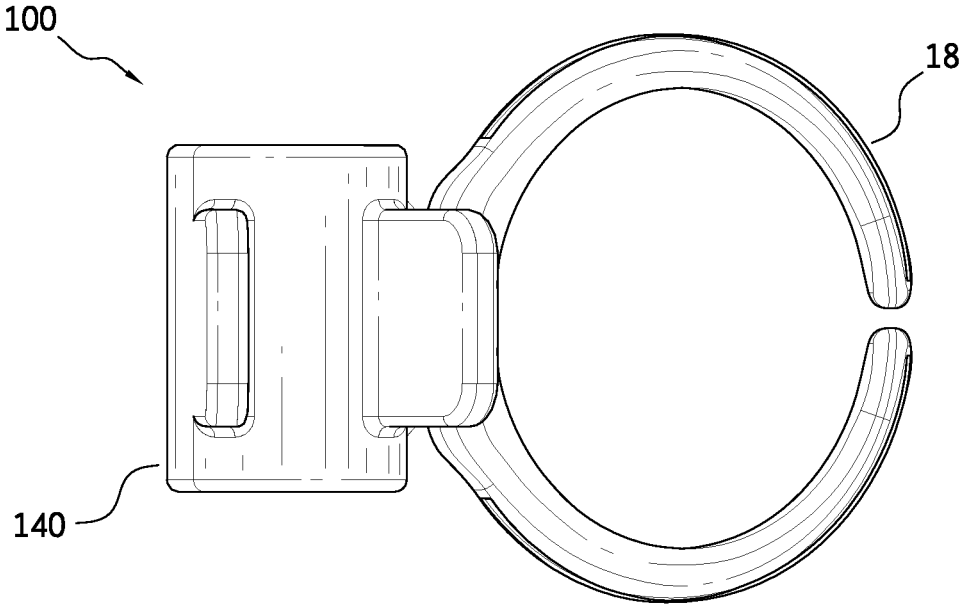
FIG. 28 is a top elevation view of the display article support system shown in FIG. 23.
Figure 29:
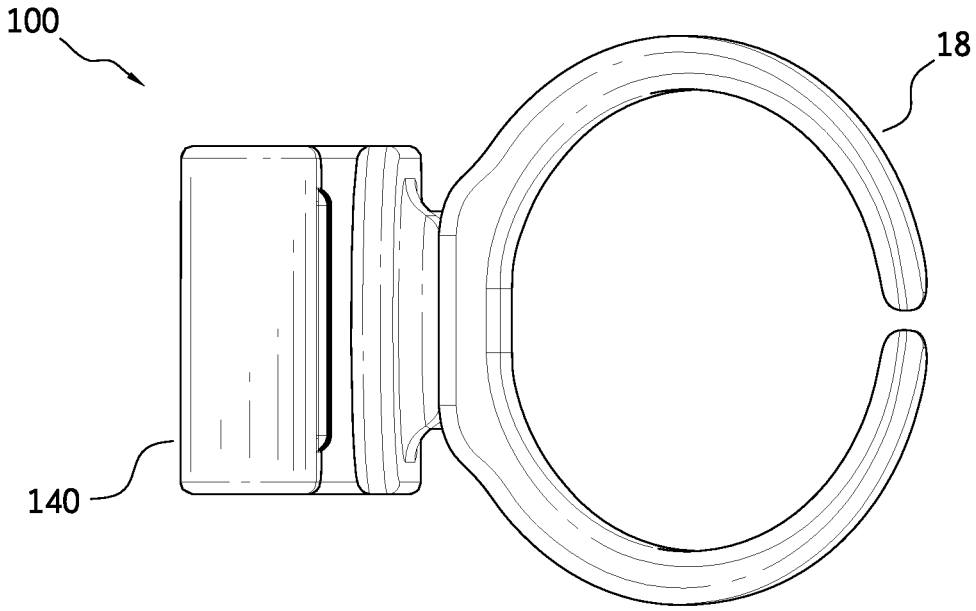
FIG. 29 is a bottom elevation view of the display article support system shown in FIG. 23.
Figure 30:
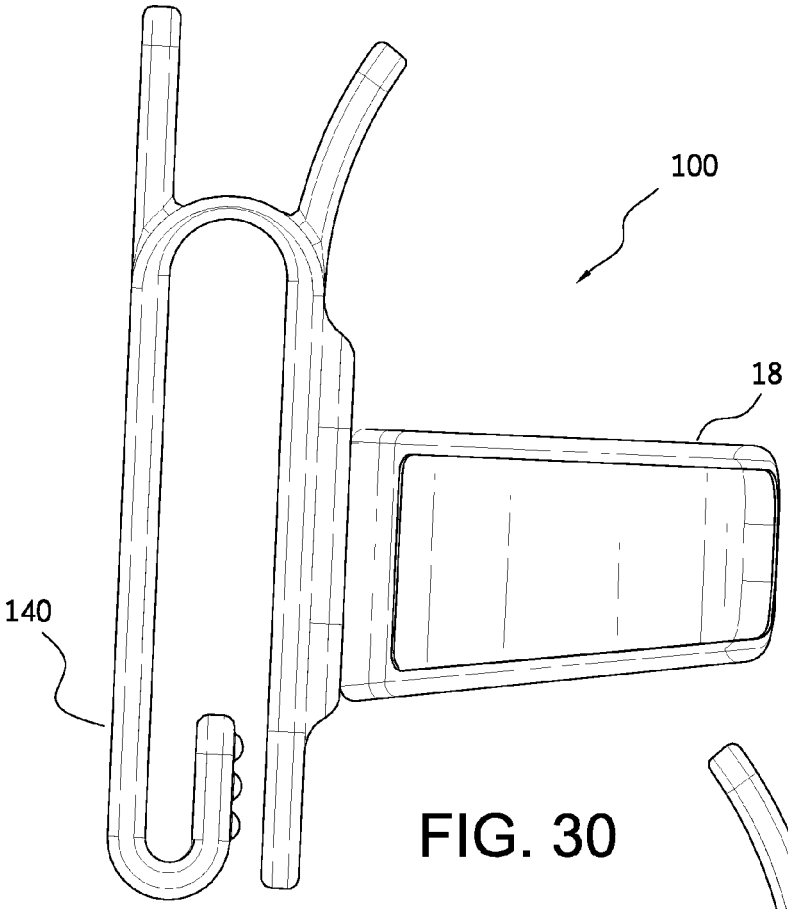
FIG. 30 is a right side elevation view of the display article support system shown in FIG. 23.
Figure 31:
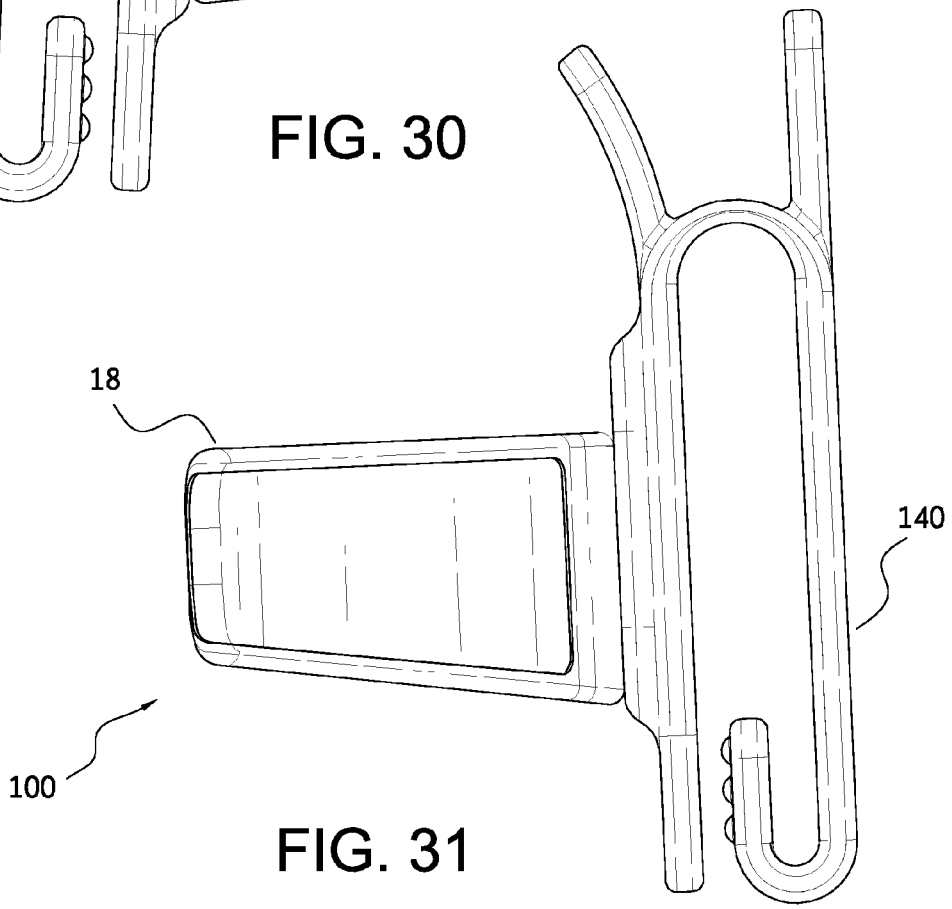
FIG. 31 is a left side elevation view of the display article support system shown in FIG. 23.
Figure 32:
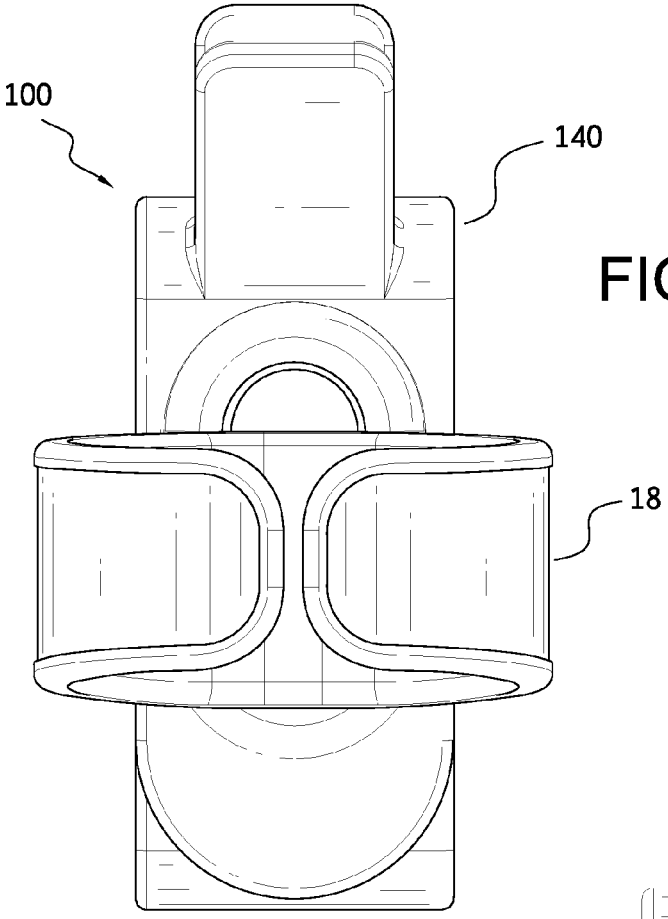
FIG. 32 is a front elevation view of the display article support system shown in FIG. 23.
Figure 33:
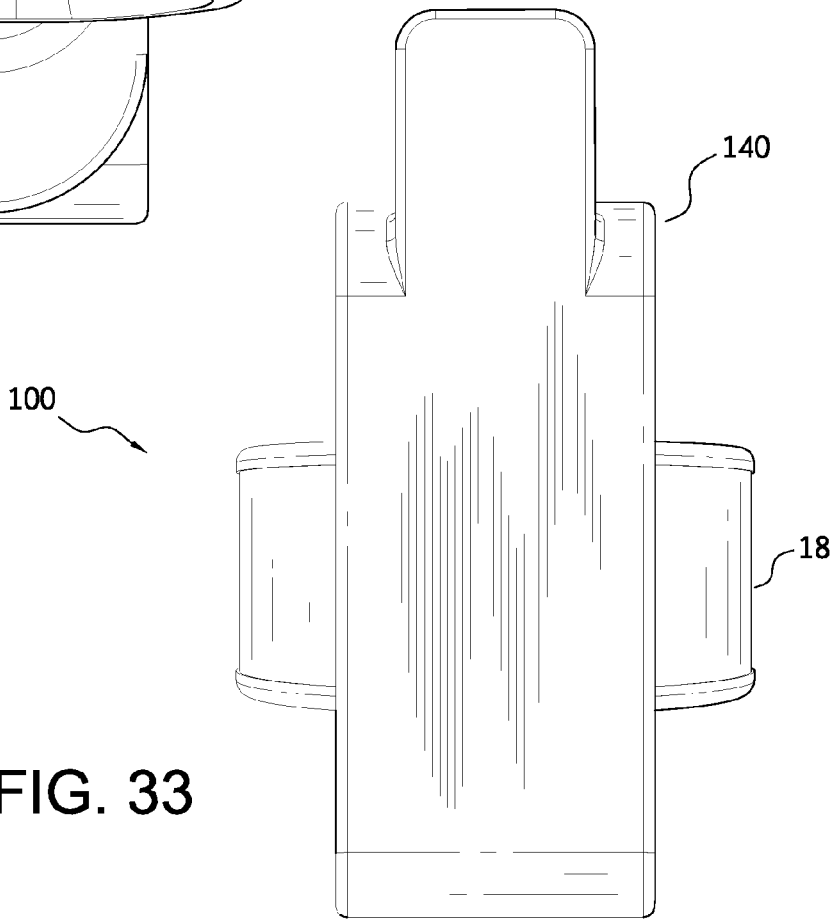
FIG. 33 is a rear elevation view of the display article support system shown in FIG. 23.

FIGS. 23-33 show alternative views of assemblies and components of a support system that includes a U-shaped secondary support clip. FIG. 23 is a perspective view of this type of display article support system 100, which includes a U-shaped support clip 140 coupled to a C-shaped support 18 via an engagement mechanism 130. In this configuration of the system, the support clip 140 may be positioned on a surface 112 such as a strap, belt, or other similar type of surface, having top and bottom surfaces 114, 116 configured for engagement with the support clip. For example, the system 100 may be attached to a belt or strap worn by a child or animal. FIGS. 24 and 25, respectively, show side and front views of the support clip 140 before attachment to the C-shaped support. FIG. 25, in particular, shows directional arrows 143 that indicate how a first mating portion (not shown) may be adjusted after insertion into an upper section 142*a* of the slotted area 160 on the second mating portion 134.

A U-shaped support clip 140 may be manufactured from one or more resilient materials such that clips can withstand repeated positioning on and off surfaces. Materials may therefore include elastomers, ceramics, and structural plastics such as ABS and polystyrene. In one configuration, a support clip has an average material thickness of about 0.120 inches.

The support clip 140 includes a first support arm 144, a second support arm 146, and a curved section 148. In FIG. 24, the support arms 144, 146 are shown substantially parallel to each other. However, in some configurations, the second support arm may project slightly toward the first support arm, depending on the properties of the support clip material. Both support arms can, however, include one or more system elements that facilitate attachment of the support clip to a surface 112.

In the embodiment shown in FIGS. 23-33, the first support arm 144 includes a segment 150, which bends inwardly towards the curved section 148. This clip configuration may also include gripping elements 156 which are integral to or attached to the segment 150. Gripping elements may also be included on a surface of the firm support arm. Fingers 152, 154 are also included on the support clip, which allow a user to bias the second support arm 146 away from the first support arm 144 for positioning on a surface 112. In other embodiments, a segment 150, gripping elements 156, and/or support arms 144, 146 may include additional elements that facilitate fastening or closure of the support clip. Such elements may include magnets, clasps, snaps, etc.

Upon placement of the system 100 onto a surface 114 such as a belt, strap, or strap-like surface, the segment 150 may be positioned to partially envelop the surface and therefore provide relatively secure positioning of a display article, particularly when the system is subject to movement. In this configuration, a second mating portion 134, having a slotted area 160 is included in the support clip 140 for mounting of the C-shaped support 18. FIGS. 26-33 show various views of an assembled system 100, where the C-shaped support 18 is mounted to the support clip 140.

Figure 34:
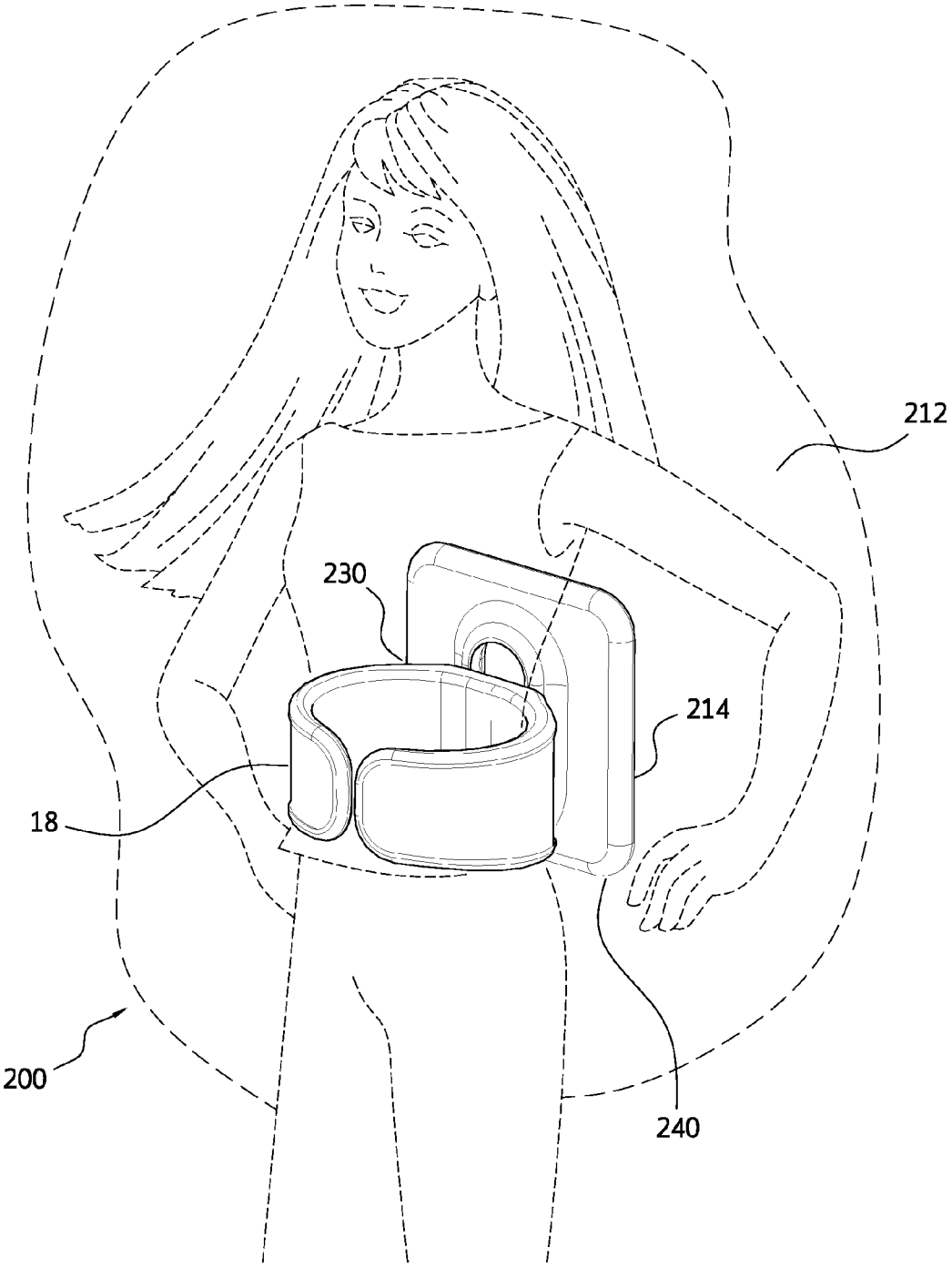
FIG. 34 is a perspective view of another configuration of a display article support system, positioned against a substantially flat surface.

FIGS. 34-43 show an embodiment of a support system using a plate-shaped magnetic, adhesive, suction, or hook-and-loop support element. FIG. 34 is a perspective view of a third type of display article support system 200, which includes a plate-shaped support element 240 configured for attachment to a C-shaped support 18, using an engagement mechanism 230. The support element 240 may be positioned against a substantially flat surface 212, using a magnets, glue, fasteners (e.g. nails or screws), double-sided tape, hooks, etc. Such surfaces include, but are not limited to, walls, refrigerators, billboards, doors, lockers, and other surfaces suitable for coupling with a plate-shaped support element. As used herein, the term plate-shaped support element should be construed as any support element having at least one substantially flat surface 214 configured for positioning against another substantially flat surface 212. For such positioning the surface 214 of the support element may be magnetized and/or include adhesive or a hook-and-loop fastening system such that the element may removably couple with the surface 212. In this embodiment of the support element 240, a coupling element 216 (FIG. 39) that is either magnetized and/or coated with an adhesive or hook-and-loop system may also be included in the support system. This element may be, for example, a magnet or adhesive strip inserted into a cavity in the support element or attached to a surface on the support element. In alternative embodiments, the coupling element 216 may be omitted.

Figure 35A:
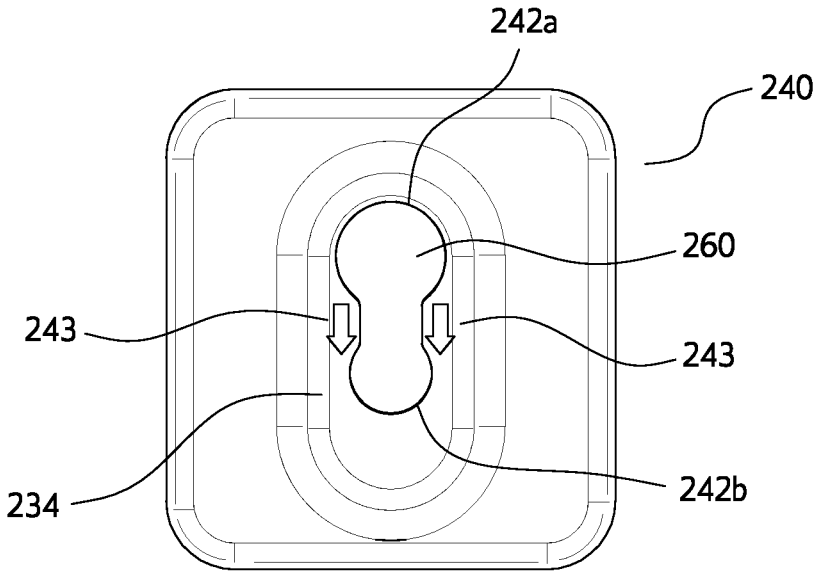
FIG. 35A is a front view of a plate-shaped support element.
Figure 35B:
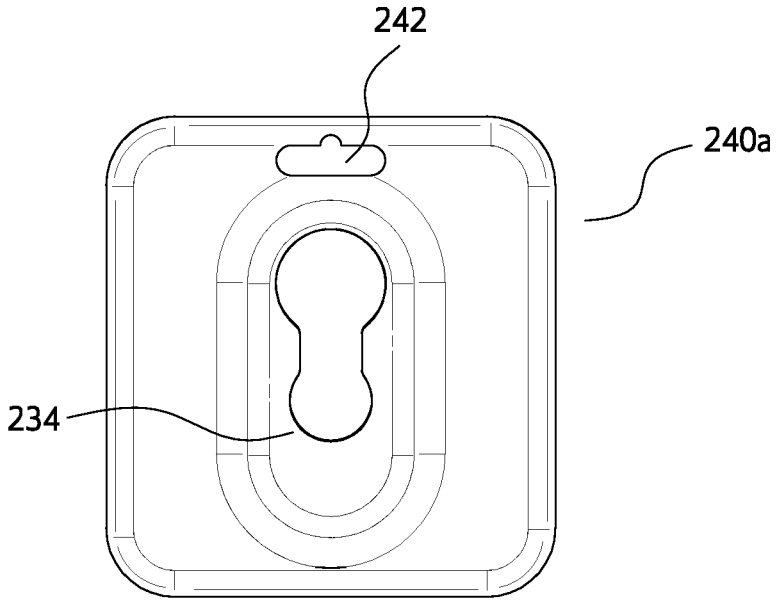
FIG. 35B is a front view of another plate-shaped support element.
Figure 36:
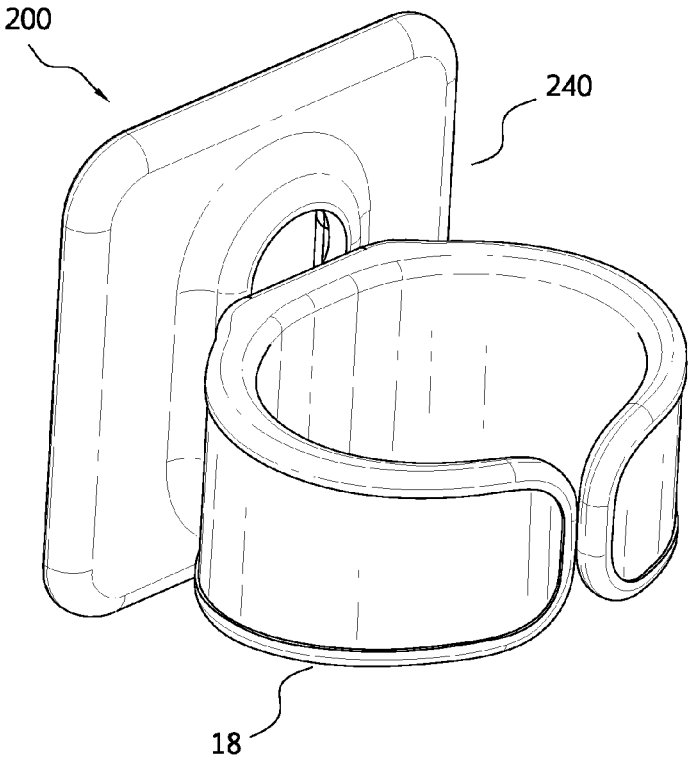
FIG. 36 is a perspective view of the display article support system shown in FIG. 34.
Figure 37:
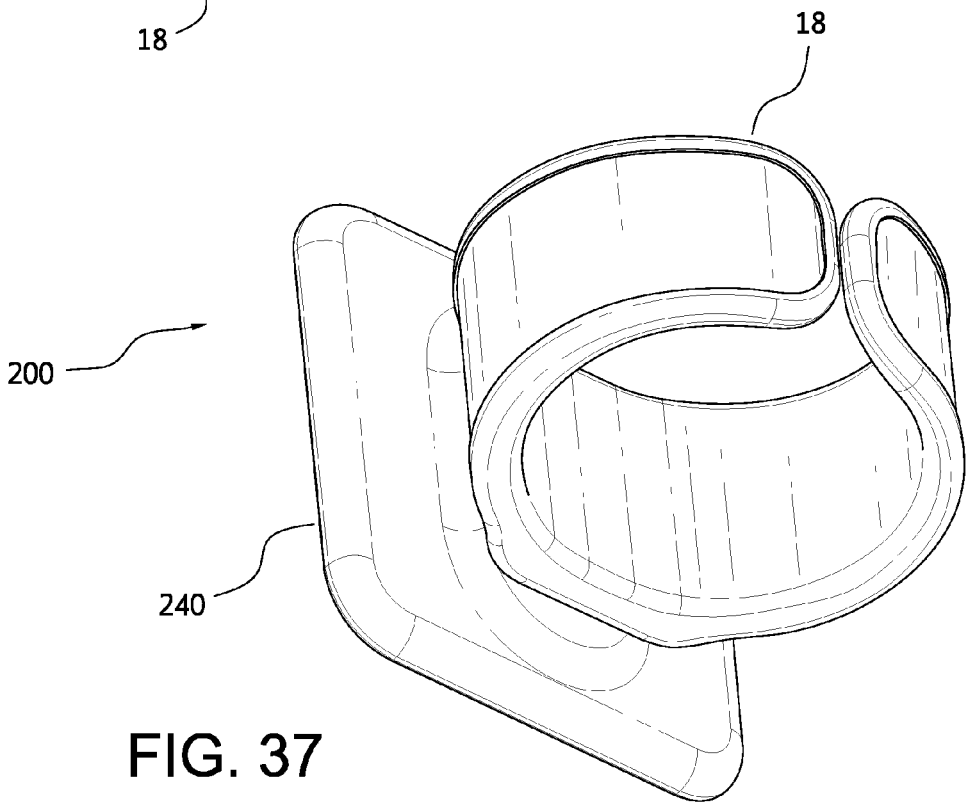
FIG. 37 is another perspective view of the display article support system shown in FIG. 34.
Figure 38:
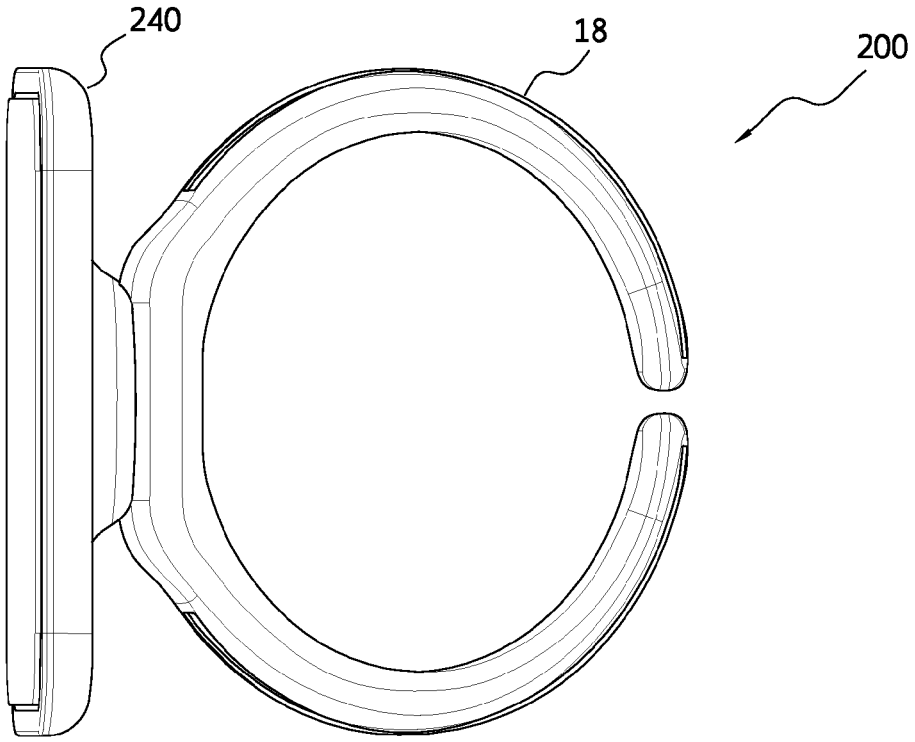
FIG. 38 is a top elevation view of the display article support system shown in FIG. 34.
Figure 39:
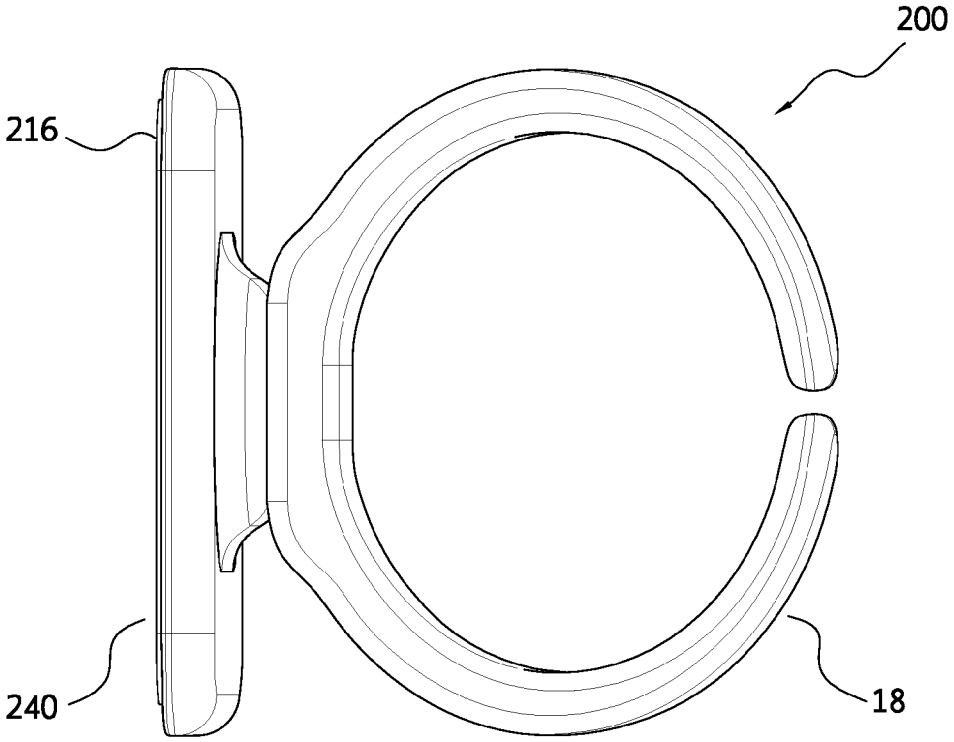
FIG. 39 is a bottom elevation view of the display article support system shown in FIG. 34.
Figure 40:
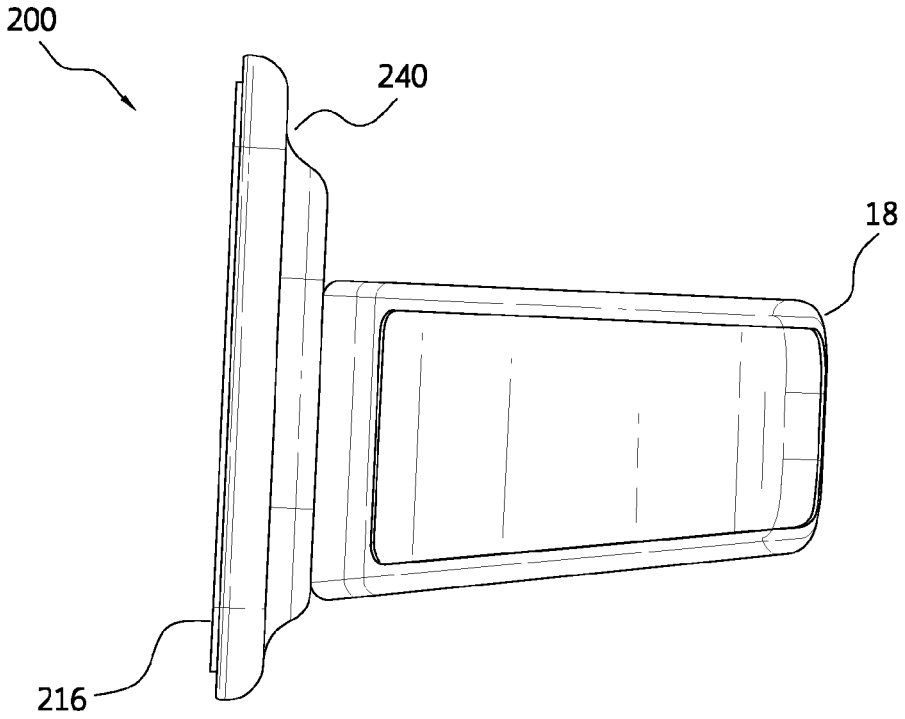
FIG. 40 is a right side elevation view of the display article support system shown in FIG. 34.
Figure 41:
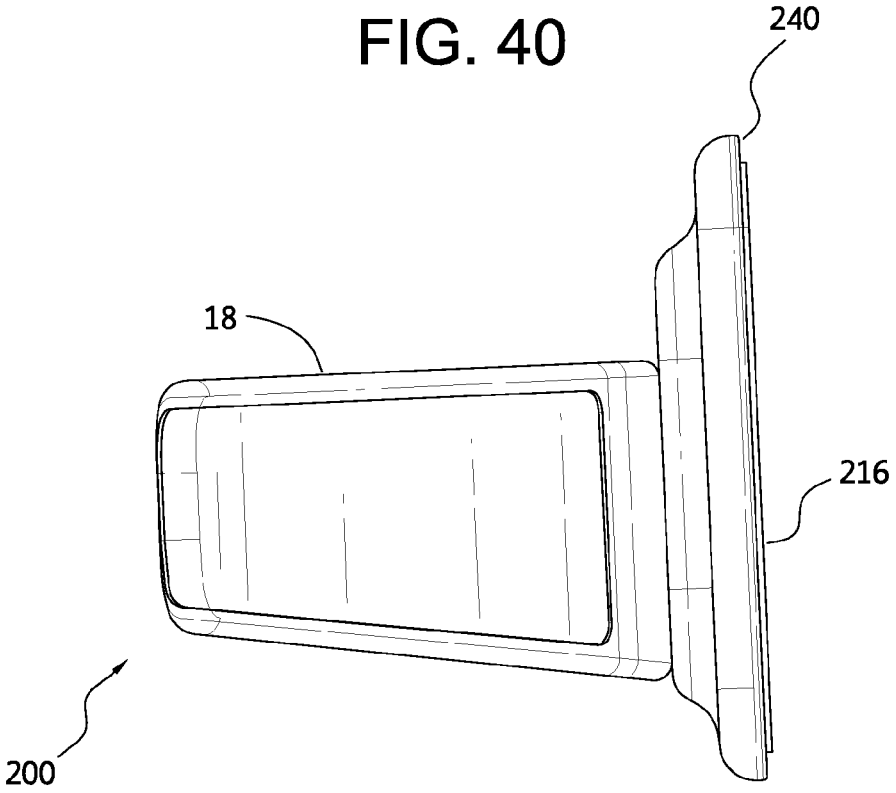
FIG. 41 is a left side elevation view of the display article support system shown in FIG. 34.
Figure 42:
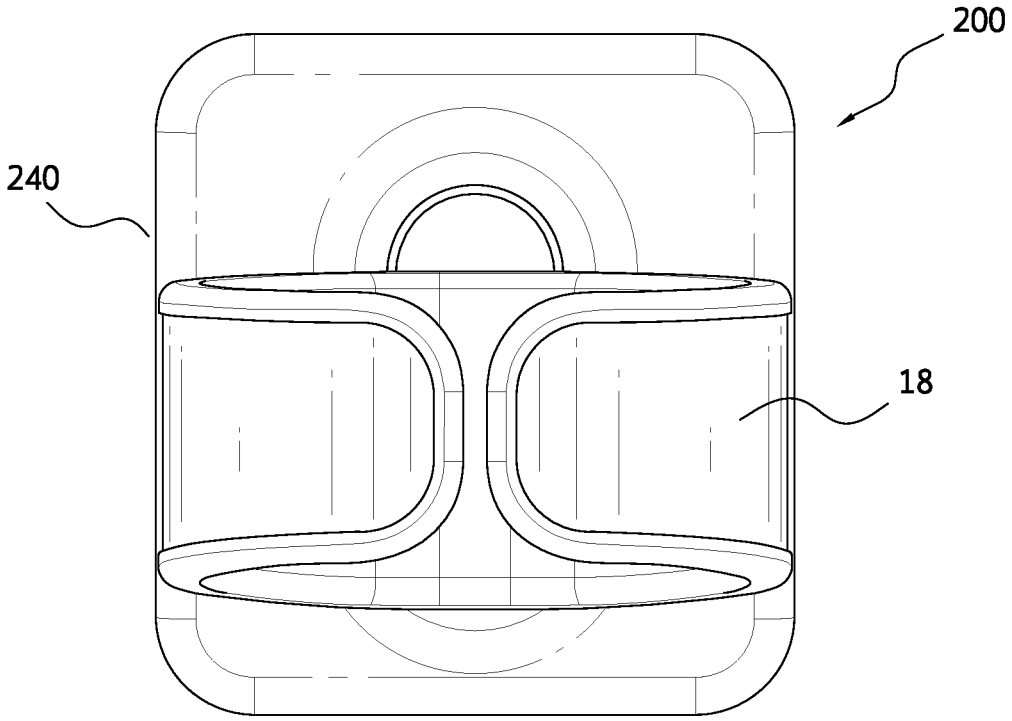
FIG. 42 is a front elevation view of the display article support system shown in FIG. 34.
Figure 43:
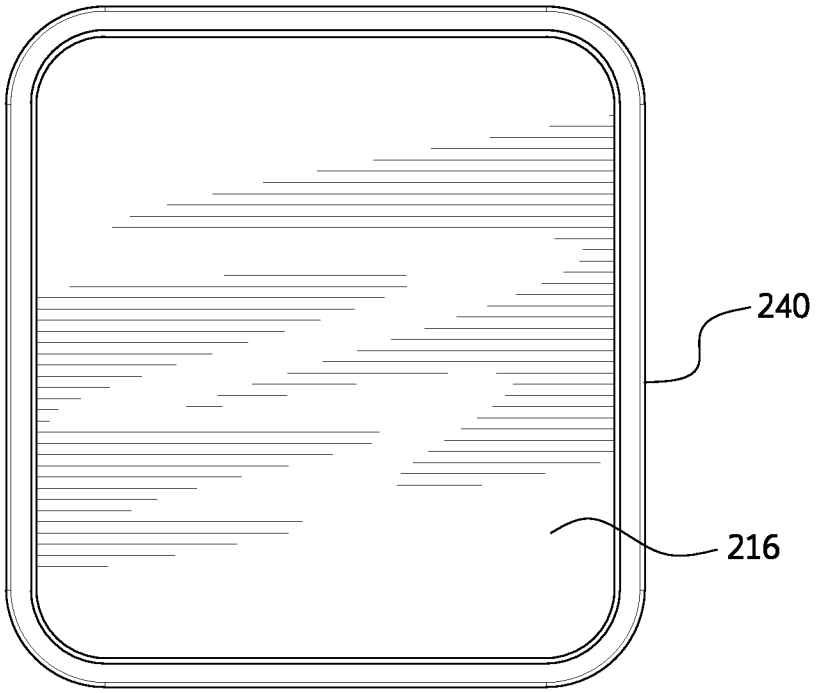
FIG. 43 is a rear elevation view of either the display article support system shown in FIG. 34 or a plate-shaped support element.

FIGS. 35A and 35B show front views of two support element configurations 240, 240*a* before attachment to a C-shaped support. Each configuration includes a second mating portion 234 having a second mating portion 234 with a slotted area 260 such that the first mating portion fits into the slotted area. Here, the second mating portion includes an upper section 242*a* and a lower section 242*b*, where the upper section has a slightly larger outer periphery than the lower section. Directional arrows 234 indicate how a first mating element 34 would be adjusted after insertion into the slotted area 260. FIGS. 36-43 show various views of the fully assembled system 200. FIG. 35B shows an alternative support element 240*a*. Here, support element 240*a* includes a mounting hole 242 that facilitates placement of the support element 240*a* on a nail or hook. A coupling element, for example, magnet, adhesive or hook-and-loop material, may be omitted from the embodiment shown in FIG. 35B. FIGS. 36-43 show various views of an assembled support system 200, where the C-shaped support 18 is mounted to the support element 240.

Figure 44:
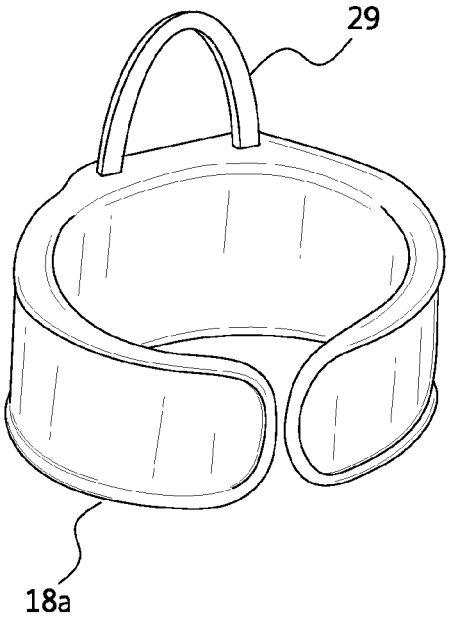
FIG. 44 shows another embodiment of a C-shaped support, including a loop element.
Figure 45:
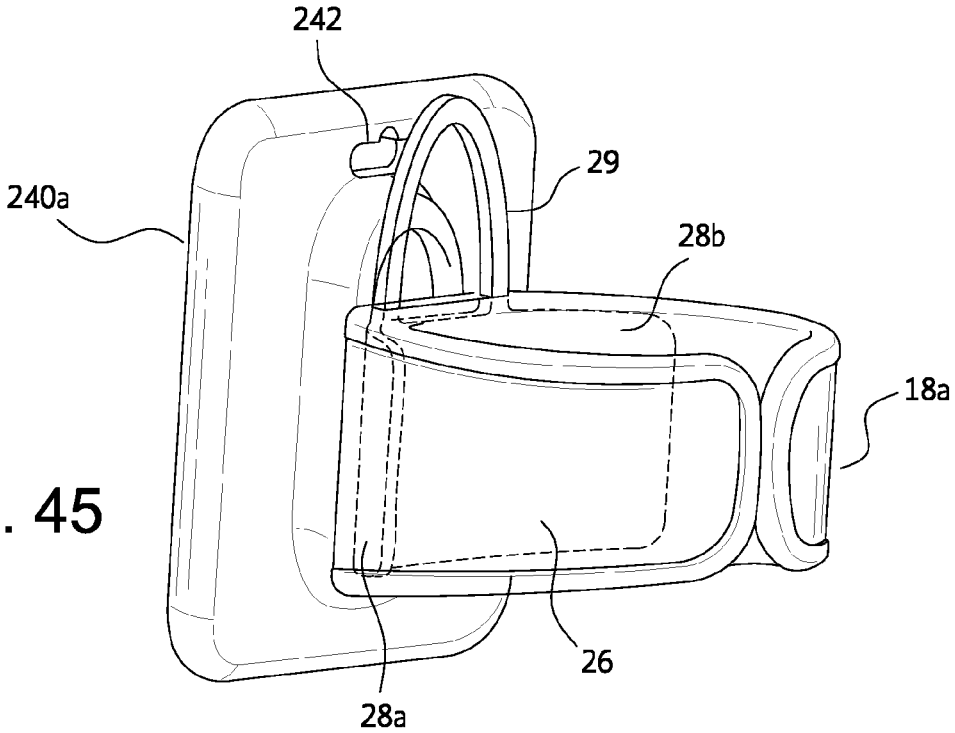
FIG. 45 shows the C-shaped support shown in FIG. 44 coupled to a plate-shaped support element.

In another embodiment, shown in FIGS. 44 and 45, the inner support 26 may also include a loop element 29 which facilitates coupling of a C-shaped support 18*a* to nails, hooks, and similar mounting devices. In the embodiment shown in FIG. 44, the C-shaped support 18*a* may be directly affixed to a surface such as a window or wall in a building or vehicle, using a pushpin, picture hook or the like, without requiring any coupling to a second support element. In the alternative, the C-shaped support 18*a* may be affixed to an article of clothing, backpack, bag, or the like, by passing a ribbon, string, chain, or similar tie member though the loop 29 and tying or fastening the C-shaped support 18*a* to the article of clothing. In such embodiments, a second support element (e.g., element 240) is not needed, and may be omitted. The C-shaped support 18*a* may be used to hold a doll or the like as described for other embodiments, but without using a secondary support member coupled to a medial portion of the support 18*a*.

FIG. 45 shows a C-shaped support 18*a* mounted to a support element 240*a*. This figure demonstrates that the modified C-shaped support 18*a* with loop 29 may also be used coupled to a secondary support 240*a*. The secondary support may, in some embodiments (for example, as described in connection with FIG. 47 below), be affixed to a wall or display board by a nail, pin, screw, or similar fastener passing though the mounting hole 242. Therefore, a user may couple the C-shaped support 18*a* with a supported doll or the like to the secondary support 240*a* using a coupling as described herein, for static display. In addition, the user may decouple the C-shaped support 18*a* from the secondary support 240*a* static display, and use the loop 29 to hold and/or display the doll or other article during transport or the like. Thus, the loop 29 or equivalent feature (hole, hook, clasp, etc.) integrated into the body of the C-shaped support 18*a* may enable alternative methods for holding or displaying the doll or similar article, without requiring more than one second secondary member of different types to be supplied with the support 18*a*.

Figure 46:
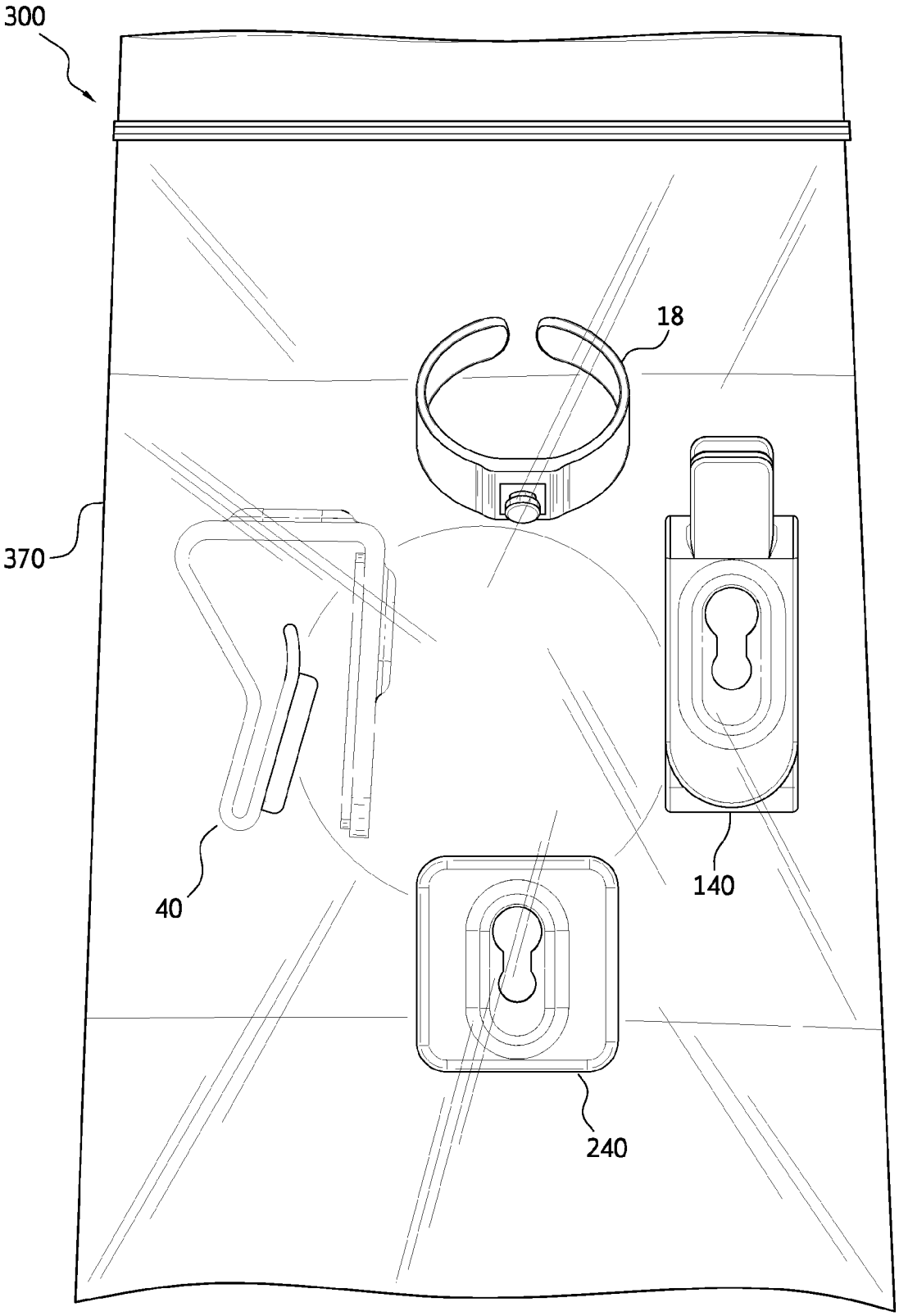
FIG. 46 shows one configuration of a display article support kit.

FIG. 46 shows one configuration of a display article support kit 300, which includes a package 370, a C-shaped support 18, a support clip 40, a u-shaped support clip 140, and a plate-shaped support element 240. Each of these elements is enclosed by the package 370. The kit may also include other types of support clips and support elements, including, but not limited to devices having one or more loops. The package may also include an article, for example a doll, to be supported by the items in the kit 300. For example, the kit 300 may be included in a package with a doll or the like, as a bonus item for incentivizing selection and purchase of the accompanying doll or the like.

Figure 47:
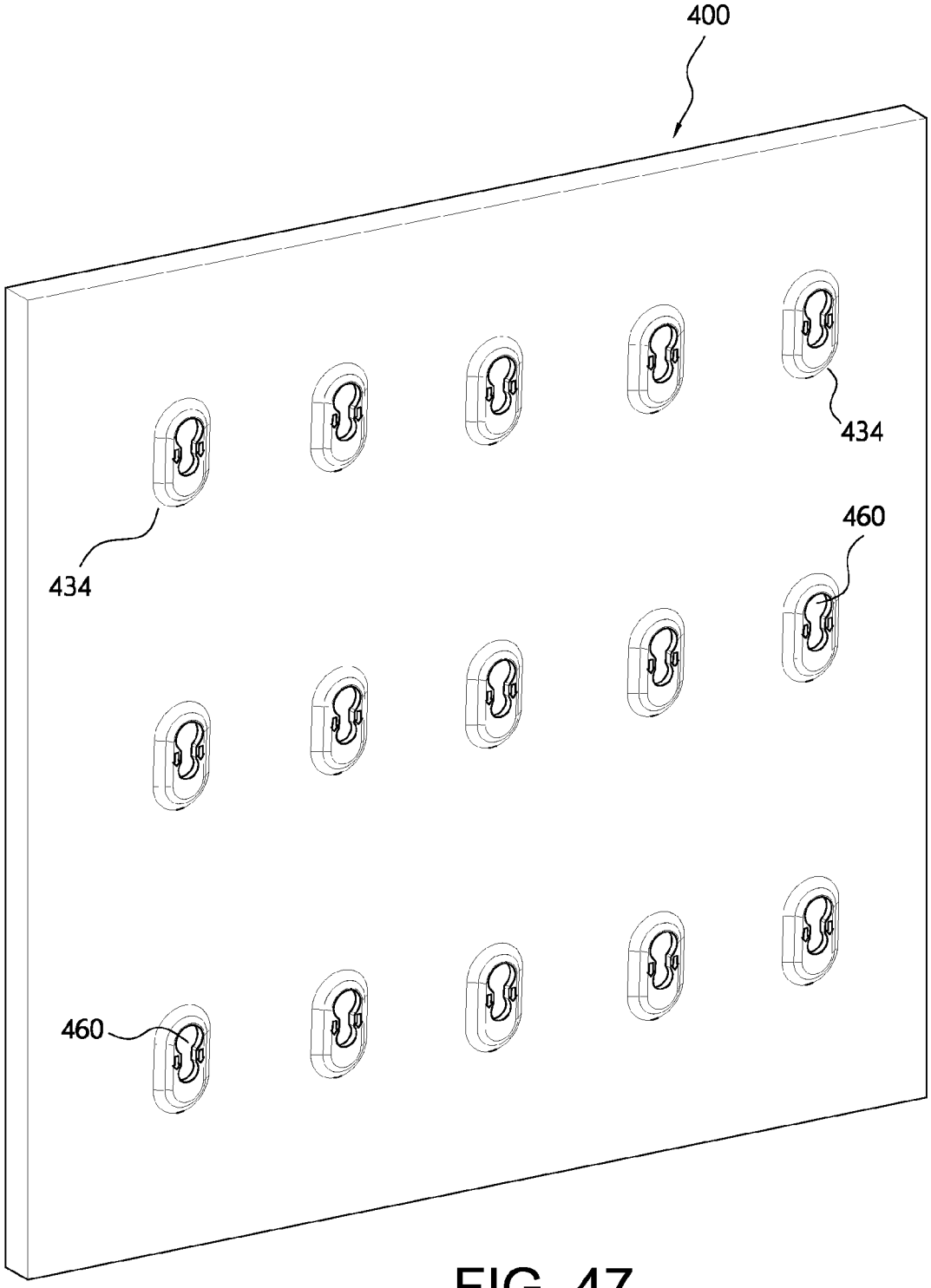
FIG. 47 is a perspective view of a display board before mounting of C-shaped supports.
Figure 48:
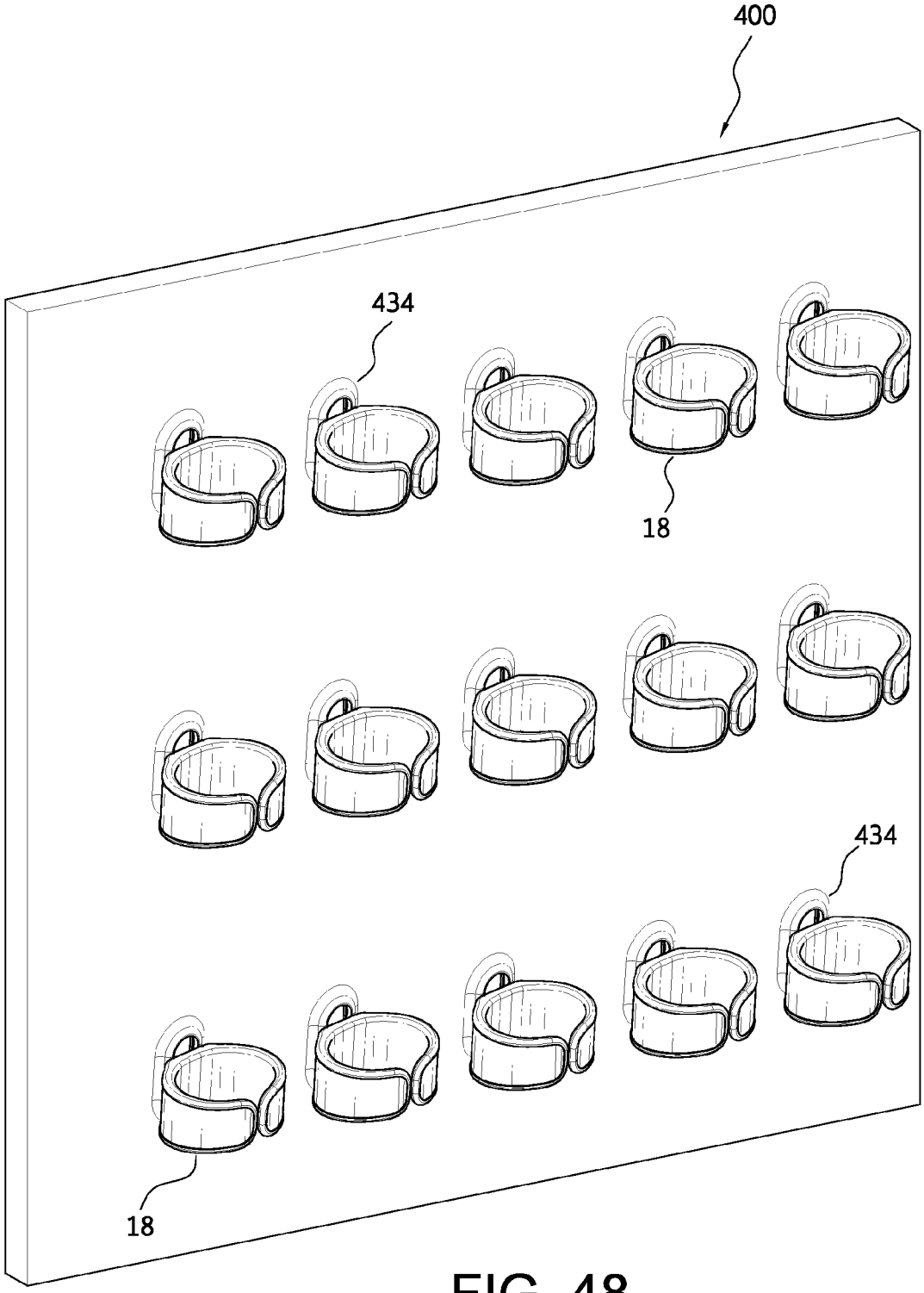
FIG. 48 is a perspective view of the display board shown in FIG. 47 after mounting of C-shaped supports.

FIG. 47 shows a display board 400 having second mating portions 434 arranged in a pattern. The display board has sufficient thickness such that it defines a plurality of slotted areas 460 in each mating portion. The mated portions 434 may be removable from the board 400 using a fastener or the like, or may be permanently affixed to, or integrated into, the board 400 using a permanent adhesive, molding process, or other method. FIG. 48 shows the display board having a plurality of C-shaped supports 18. The C-shaped supports may include first mating portions 32 (not shown) for positioning into section mating portions 434 for mounting of multiple display articles (not shown). Thus, the C-shaped supports 18 may be removable from the board, and once removed, may be suitable for other uses as described elsewhere herein. The C-shaped support 18 may be used to support a doll or the like as described elsewhere herein.

Figure 49:
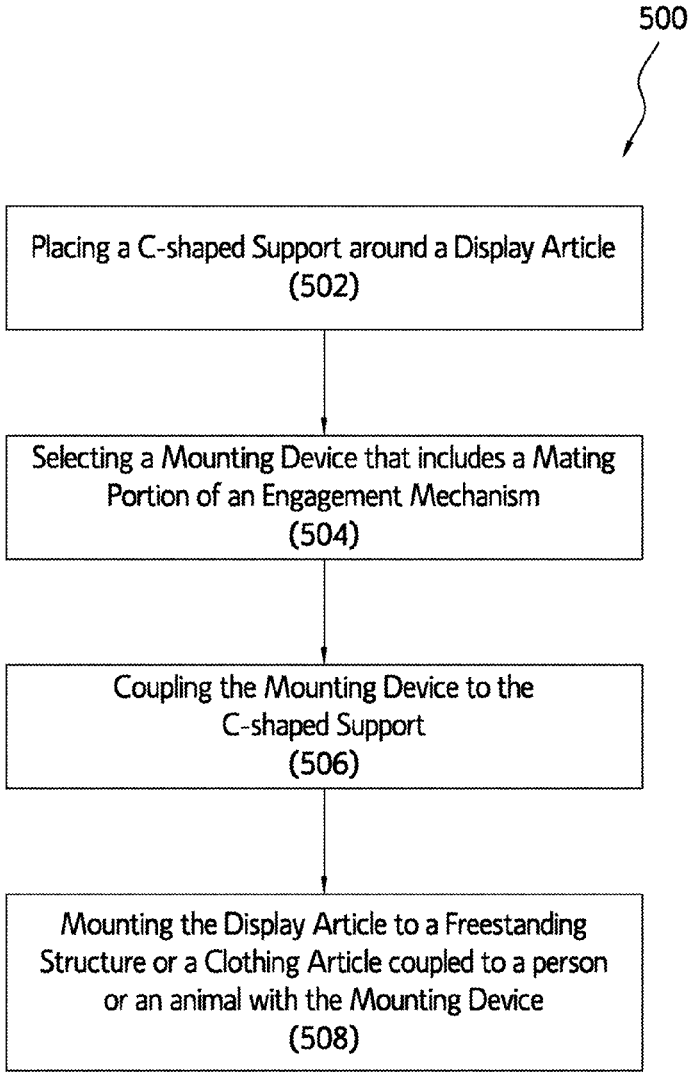
FIG. 49 is a flowchart showing steps of mounting a display article onto a display article support system.

Another aspect of the invention includes a method for mounting a doll 500, as shown in FIG. 49. The method includes steps of: placing a C-shaped support around a play FIG. 502, wherein the C-shaped support comprises opposing arcuate arms extending from a medial portion of the support and a first mating portion of an engagement mechanism; selecting a mounting device from one of a support clip, a plate-shaped support element, and a display board 504, wherein each mounting device include a second portion of the engagement mechanism configured for coupling to the C-shaped support; coupling the mounting device to the C-shaped support 506; and mounting a display article to a freestanding structure or a belt, strap, or other article coupled to a person or animal, using the mounting device 508.

An additional step may include attaching a support clip to an article of clothing worn by a person or a piece of furniture 510, where the piece of furniture serves as the attachment point. For example, the clip may be attached to a vertical edge of a generally horizontal slab member of the furniture or an edge of a generally vertical slab member of the furniture. Where the support clip or element is magnetized, the method may also include attaching a magnetic element coupled to the support clip or element to a metallic-based surface 512. Similarly, a method of mounting a display article or a play figure may further include providing an adhesive such that a support clip or support element may be positioned on or against any surface. Further details of method for mounting the display article or play figure has been described herein above in connection with the drawings of the various mounting components and assemblies.

Accordingly, a display article support system, kit and a method of mounting a display article are disclosed. A more complete understanding of the systems, kits, and methods disclosed herein will be afforded to those skilled in the art, as well as a realization of additional advantages and objects thereof, by consideration of the following detailed description. Reference will be made to the appended sheets of drawings which will first be described briefly.

While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A display article support system, comprising:

a C-shaped support comprising opposing arcuate arms extending from a medial portion; and a mounting device comprising a dual-orientation support clip removably coupled to the C-shaped support by an engagement mechanism, the engagement mechanism comprising a first mating portion and a second mating portion and the dual-orientation support clip comprising a first support arm and a second support arm integrated with dual instances of the second mating portion, wherein the dual instances of the second mating portion are oriented relative to the first and second support arms for holding the C-shaped support in a vertical orientation while engaging any one of a substantially horizontal or vertical surface, wherein a first one of the dual instances of the second mating portion is located on the first support arm, and a second one of the dual instances of the second mating portion is located on the second support arm, and wherein the first mating portion includes a post configured for slideable engagement with the second mating portion comprising a slot in an outwardly offset portion of the mounting device, whereby when the post is engaged in the slot, the post is located entirely between an innermost surface of the mounting device adjacent to the outwardly offset portion and an outer surface of the outwardly offset portion where the post enters the slot.

2. The system of claim 1, further comprising a display article supported by the C-shaped support.

3. The system of claim 1, wherein the C-shaped support further comprises an inner support disposed within the medial portion and at least a portion of each opposing arcuate arm.

4. The system of claim 3, wherein the inner support is integrally molded with the first mating portion.

5. The system of claim 3, wherein the inner support removably coupled with the first mating portion.

6. The system of claim 1, wherein the mounting device comprises at least two support arms.

7. The system of claim 1, wherein the mounting device comprises at least two second mating portions.

8. The system of claim 7, wherein the mounting device comprises at least one gripping element.

9. The system of claim 1, wherein the second mating portion includes a slotted area.

10. The system of claim 1, wherein the engagement mechanism comprises a twist-activated locking mechanism.

11. The system of claim 1, wherein the mounting device is configured for interchangeably coupling to the C-shaped support by the engagement mechanism.

12. The system of claim 1, wherein the opposing arcuate arms are resilient.

13. The system of claim 1, wherein the first support arm extends at a right angle with respect to the second support arm.

14. The system of claim 13, wherein the first support arm comprises multiple segments configured for resilient opening of the first support arm relative to the second support arm.

15. The system of claim 14, wherein the multiple segments comprise a first segment that extends towards the second support arm at an acute angle with respect to the first support arm, and a second segment that extends at an obtuse angle with respect to the first segment.

16. The system of claim 15, wherein the multiple segments further comprise a third segment folded generally parallel to the second segment towards the second support arm.

17. The system of claim 16, further comprising a first soft elastomeric gripping element fixed to the third segment opposite to a second soft elastomeric gripping element fixed to a facing surface of the second support arm.

* * * * *